US012044509B1

(12) United States Patent
Borter

(10) Patent No.: US 12,044,509 B1
(45) Date of Patent: Jul. 23, 2024

(54) PROJECTILE ENTANGLING DEVICE, CARTRIDGE AND METHOD

(71) Applicant: Clifford L. Borter, Tampa, FL (US)

(72) Inventor: Clifford L. Borter, Tampa, FL (US)

( * ) Notice: Subject to any disclaimer, the term of this patent is extended or adjusted under 35 U.S.C. 154(b) by 0 days.

(21) Appl. No.: 18/195,575

(22) Filed: May 10, 2023

Related U.S. Application Data

(62) Division of application No. 17/501,274, filed on Oct. 14, 2021, now Pat. No. 11,674,778.

(60) Provisional application No. 63/091,537, filed on Oct. 14, 2020.

(51) Int. Cl.

| | |
|---|---|
| ***F42B 12/66*** | (2006.01) |
| ***F41B 11/55*** | (2013.01) |
| ***F41B 11/62*** | (2013.01) |
| ***F41B 11/723*** | (2013.01) |
| ***F41B 11/80*** | (2013.01) |
| ***F41H 13/00*** | (2006.01) |

(52) U.S. Cl.
CPC ..... *F41H 13/0006* (2013.01); *F41B 11/55* (2013.01); *F41B 11/62* (2013.01); *F41B 11/723* (2013.01); *F41B 11/80* (2013.01)

(58) Field of Classification Search
CPC .. F41H 13/0006; F41H 13/0025; F41B 11/55; F41B 11/62; F41B 11/723; F41B 11/80; F42B 12/66; F42B 7/04; F41A 1/00; F41A 21/32
USPC ..... 102/504, 439, 457, 438, 502; 124/1, 59, 124/71–77; 89/1.34, 1.11
See application file for complete search history.

(56) References Cited

U.S. PATENT DOCUMENTS

| | | | | |
|---|---|---|---|---|
| 347,988 | A | 8/1886 | Boyd | |
| 1,198,035 | A | 9/1916 | Huntington | |
| 1,211,001 | A | 1/1917 | Steinmetz | |
| 1,345,082 | A * | 6/1920 | Fuller | B02C 15/08 241/173 |
| 1,488,182 | A | 3/1924 | Whelton | |
| 1,536,164 | A | 5/1925 | Tainton | |
| 2,354,451 | A | 7/1944 | Forbes | |
| 2,373,364 | A | 4/1945 | Wellcome | |
| 3,085,510 | A | 4/1963 | Campbell | |
| 3,803,463 | A | 4/1974 | Cover | |
| 3,921,614 | A | 11/1975 | Fogelgren | |

(Continued)

OTHER PUBLICATIONS http://www.wrap.com/bolawrap/.

*Primary Examiner* — Michael D David
(74) *Attorney, Agent, or Firm* — Frijouf, Rust & Pyle, P.A.

(57) ABSTRACT

A projectile entangling device, cartridge and method for entangling an object. The projectile entangling device comprises a bolt slidably engaging within a receiver. A barrel is coupled to the receiver and is adjacent to a chamber. A gas conduit couples a compressed gas container to the bolt. A valve is positioned within the gas conduit. A trigger activates the valve and dispensing a compressed gas from the compressed gas container, through the gas conduit and exits the bolt. A first projectile and a second projectile are positioned within the cartridge. A tether is coupled to the first projectile and the second projectile. The first projectile, the second projectile and the tether are propelled from the cartridge and expelled from the barrel upon the compressed gas exiting the bolt. The tether elongates for distancing the first projectile from the second projectile for defining an expanding projectile and entangling with the object.

8 Claims, 17 Drawing Sheets

(56) References Cited

U.S. PATENT DOCUMENTS

| | | | | |
|---|---|---|---|---|
| 4,559,737 | A | 12/1985 | Washington | |
| 4,664,034 | A | 5/1987 | Christian | |
| 5,315,932 | A | 5/1994 | Bertram | |
| 5,326,101 | A | 7/1994 | Fay | |
| 5,396,830 | A * | 3/1995 | Kornblith | F41F 1/00 102/504 |
| 5,561,263 | A | 10/1996 | Baillod | |
| 5,750,918 | A | 5/1998 | Mangolds et al. | |
| 5,988,036 | A | 11/1999 | Mangolds et al. | |
| 6,381,894 | B1 | 5/2002 | Murphy | |
| 6,382,071 | B1 | 5/2002 | Bertani | |
| 7,950,176 | B1 | 5/2011 | Nemlyshkin et al. | |
| 8,245,617 | B2 | 8/2012 | Martinez et al. | |
| 8,757,039 | B2 | 6/2014 | Martinez et al. | |
| 8,857,305 | B1 | 10/2014 | Tseng | |
| 9,895,579 | B1 | 2/2018 | Walterscheid | |
| 9,989,336 | B2 | 6/2018 | Purvis | |
| 10,036,615 | B2 | 7/2018 | Norris et al. | |
| 10,107,599 | B2 | 10/2018 | Norris et al. | |
| 10,345,082 | B2 | 7/2019 | Norris et al. | |
| 10,551,152 | B2 | 2/2020 | Norris et al. | |
| 10,634,461 | B2 | 4/2020 | Norris et al. | |
| 2017/0276461 | A1 | 9/2017 | Norris et al. | |
| 2017/0276467 | A1* | 9/2017 | Hassan, III | G01M 15/14 |
| 2018/0094908 | A1* | 4/2018 | Down | F41G 3/06 |
| 2018/0362191 | A1* | 12/2018 | Russell | F42B 12/66 |
| 2018/0372456 | A1* | 12/2018 | Norris | F41H 13/0006 |

* cited by examiner

PROJECTILE ENTANGLING DEVICE, CARTRIDGE AND METHOD

CROSS-REFERENCE TO RELATED APPLICATIONS

This application is a division of application Ser. No. 17/501,274 filed Oct. 14, 2021. All subject matter set forth in application Ser. No. 17/501,274 is hereby incorporated by reference into the present application as if fully set forth herein.

Application Ser. No. 17/501,274 claims benefit of U.S. Patent Provisional Application No. 63/091,537 filed Oct. 14, 2020. All subject matter set forth in Provisional Application No. 63/091,537 is hereby incorporated by reference into the present application as if fully set forth herein.

BACKGROUND OF THE INVENTION

Field of the Invention

This invention relates a projectile device and more particularly to a projectile entangling device, cartridge and method.

Background of the Invention

A dangerous individual or animal which is confronting or fleeing may be neutralized by deadly force or nondeadly force. Deadly force would preferably only be utilized wherein the dangerous individual or animal is a serious threat to great bodily harm to a person. In many instances the intention of the individual or animal is not readily apparent or easily established by a person to determine whether great bodily harm will ensue. In addition, the use of deadly force can produce irrevocable bodily injury and death to the dangerous individual or animal. Furthermore, the use of deadly force can produce irrevocable bodily injury and death to an innocent bystander. There is a need for a device that may be utilized to neutralize a dangerous individual or animal without the use of deadly force.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 347,988 to Boyd discloses a cartridge having the charge of shot the individual members of which are connected together, and which spread apart at relatively fixed intervals, the connecting medium of which is wound around an intermediate piece of material disposed in the cartridge, substantially as and for the purpose specified.

U.S. Pat. No. 1,198,035 to Huntington discloses a projectile divided longitudinally in sections, and flexible means which by being wound around the projectile hold the sections together normally and also form connecting members between the sections after said sections have separated.

U.S. Pat. No. 1,211,001 to Steinmetz discloses a projectile the combination with a shell containing an explosive charge, of continuous barbed wire inclosed within the shell arranged therein to be readily extended by the explosion of said charge and having a length many times the greatest dimension of the latter, and means for exploding the shell.

U.S. Pat. No. 1,488,182 to Whelton discloses an ordnance projectile, a hollow shell containing a powder charge and timed exploding means, and containing above the powder charge a spreading missile wholly separable from the shell, consisting of a plurality of weights adapted to spread centrifugally when released and a system of wires interconnecting the weights, together with an interior device, independent of said missile and wires for normally locking said weights inwardly, and releasing them after their discharge.

U.S. Pat. No. 1,536,164 to Tainton discloses a projectile comprising a plurality of explosive segments of substantially equal weight, provided with a suitable rifling band and adapted to be projected from a gun as a unitary projectile, a member binding said segments rigidly together and containing an explosive, means ignited by the propelling charge for dislodging the binding member to permit the segments to separate from each other by centrifugal force, a flexible connector connected to the several segments and provided with anchoring means near the ends holding the segments to cause the projectile to become entangled with or anchored to a target such as an aeroplane, said segments constructed with time fuses.

U.S. Pat. No. 2,354,451 to Forbes discloses a cartridge having a base for holding powder, a bullet removably carried by the base and having a cylindrical fusible wall, a chain shot disposed within the cylindrical wall and consisting of a plurality of bars linked together, one end of the chain shot being connected to the bullet, said bullet being rotated as it leaves the gun, means for melting the fusible wall while the bullet is in flight for permitting the chain shot to expand, the rotation of the bullet causing the chain shot to form into a spiral.

U.S. Pat. No. 2,373,364 to Wellcome discloses a bolas projectile of the character described comprising, in combination, a plurality of weights each positioned eccentric to the axis of the projectile, wires connecting said weights to each other, said wires being twisted together to form a cable and said cable being formed into a coil, and means other than the weights for uncoiling said cable.

U.S. Pat. No. 3,085,510 to Campbell discloses a shotgun cartridge comprising: a cylindrical casing, a base having a primer closing one end of said casing, a charge of powder within said casing and adjacent said base, wadding in said cartridge and covering said powder, a plurality of buckshot, tie lines having the ends thereof secured respectively to said buckshot, said tie lines being secured to each other for limiting the spread pattern of said buckshot, a wrapper having edges and forming a bag containing said buckshot and portions of said lines adjacent said buckshot, the remainder portions of said lines extending outwardly of said bag, said edges of said wrapper forming a crimped portion closely closed around said lines, said bag being contained in said casing above and adjacent said wadding with said crimped portion facing toward said powder and the remainder portions of said lines being wadded adjacent said crimped portion, whereby said bag is removed from said shot as it leaves the barrel upon firing said cartridge from a shotgun.

U.S. Pat. No. 3,803,463 to Cover discloses a weapon for subduing and restraining includes a harmless projectile that is connected by means of a relatively fine, conductive wire to a launcher which contains an electrical power supply. The projectile is intended to contact a living target without serious trauma and to deliver an electric charge thereto sufficient to immobilize. In different embodiments, the projectile can be a pellet, a net or a combination of pellets and a net. The magnitude and frequency of the electrical impulses delivered to the target can be controlled at the launcher, and would range in effect from immobilizing to potentially "lethal" levels.

U.S. Pat. No. 3,921,614 to Fogelgren discloses a compressed gas operated hand gun includes an annular firing chamber defined between the sides of a main piston and the wall of a bore, the forward end of the piston cooperating with an annular valve seat which communicates with a projectile-holding chamber. In a cocked position the piston is held in sealing engagement with the valve seat by a trigger assembly and is biased in an opposite direction by the gas pressure in the firing chamber. Upon actuation of the trigger assembly the piston moves away from the valve seat and releases the charge of gas against the projectile. A fresh charge of gas is introduced into the firing chamber automatically from a high pressure gas chamber by a piston valve assembly concentrically disposed in the main piston and operated in response to gas pressure in the high pressure chamber.

U.S. Pat. No. 4,559,737 to Washington discloses a device which enables a person to capture a fugitive without injuring the fugitive. The device comprises a tubular body having angularly disposed tubular barrels extending therefrom. The barrels each have a slot extending along the length thereof such that a pair of projectiles can be loaded into the device while a flexible line interconnects the pair of projectiles. To catch the fugitive, the device is aimed at the fugitive and the pair of projectiles are propelled from the barrels in diverging lines of flight. As the line extends between the diverging projectiles, the fugitive is engaged by the line. The momentum of the moving projectile causes the projectiles to wrap the line about the fugitive thereby entangling him and preventing him from further fleeing.

U.S. Pat. No. 4,664,034 to Christian discloses a cartridge for use in firearms contains fettered shot therein. The fettered shot enables eight or more pellets to be discharged in a tight group and in a manner which increases the effective range of the firearms. The fettered shot of the present invention is especially useful against helicopters and airborn troop assaults.

U.S. Pat. No. 5,315,932 to Bertram discloses a shot cartridge is made to contain a projectile system for harmlessly ensnaring a fleeing person. The projectile system employs three or four buckshot paired with an equal number of twinned fish hooks. Each buckshot and fish hook pair is joined by a thin strong line, and all said lines are joined at a single site. The fish hooks are separately housed adjacent the rear of the cartridge. The buckshot are separately housed adjacent the front of the cartridge. The line is housed within the cartridge in a compacted state. When fired, the projectile system deploys with an assured wide pattern.

U.S. Pat. No. 5,326,101 to Fay discloses a law enforcement baton for enhanced suspect control and apprehension comprises detachable, coextensive, proximal and distal lengths with a handle portion removably perpendicularly attached thereto with the handle portion and distal length being of identical construction and interchangeable upon the baton. The distal length includes a central bore with a plurality of reduced diameter bore holes extending parallel thereto in annularly spaced relation thereabout. A net having a plurality of elastic lines with retaining elements attached thereto is removably positioned within the central bore and the plurality of bore holes, respectively. The proximal length includes an opening wherein a compressed air canister is removably inserted with the sealed end thereof being in fluid communication with the bore openings in the distal length when the proximal and distal lengths are attached together. A sharp member located internally of the distal length is movable via a solenoid to break the seal of the canister upon pressing a button located on the outwardly facing surface of the distal length. When the seal is broken, compressed air creates a force against the net and flexible lines in the distal length thereby projecting the net and lines therefrom a distance sufficient to entrap an unwary criminal suspect. The net is directed at and impacts the upper torso region of the suspect with the elastic lines wrapping there around with the retaining elements engaging the net thereby enveloping the suspect's arms to facilitate subsequent apprehension of the suspect.

U.S. Pat. No. 5,561,263 to Baillod discloses a device for capturing humans or animals, comprises a pair of projectiles each having a forward head and a rear shank. Each shank is semi-cylindrical and offset to one side of its associated head, such that when the projectiles are placed together with their shanks contiguous to each other, the two shanks together form a cylindrical body and the two heads together form a flattened body disposed in a plane perpendicular to a mating plane of the two shanks. A flexible tether interconnects the two projectiles, whereby when the two shanks are disposed contiguous to each other and inserted in the bore of the barrel of a firearm, and the firearm is fired, the two shanks will impart thrust to their respective projectiles along lines of force disposed to one side of a center of gravity of each projectile. These centers of gravity are thus disposed on opposite outward sides of those lines of thrust and lie in the plane of the flattened body, whereby when the device leaves the firearm, the projectiles will diverge to extend the tether between them in the plane of the flattened body. Hooks are carried by the heads for retarding disengagement of the device from a captured human or animal. The hooks have shanks extending through the heads whereby the hooks are slidable forwardly and rearwardly relative to the heads. When the device is launched, the hooks occupy a retracted position, but slide to an extended position by inertia when the device is stopped by a captured human or animal.

U.S. Pat. No. 5,750,918 to Mangolds, et al. discloses a ballistically deployed restraining net system including a projectile, a net packaged in the projectile, a net deployment device for unfurling the net in flight, and a fuze for triggering the net deployment device upon the occurrence of a preestablished criteria such as the impact of the projectile with an object, the expiration of a preestablished time period after launch or upon the projectile reaching a predetermined distance to an object.

U.S. Pat. No. 5,988,036 to Mangolds, et al. discloses a ballistically deployed restraining net system including a cartridge receivable within a barrel, the cartridge having a base and an opposing open end. There is a restraining net packaged in the cartridge and a set of weights attached to the restraining net and packaged within the cartridge between the base of the cartridge and the restraining net. A deployment charge ejects the restraining net and the set of weights out of the barrel and out of the cartridge and a spreader charge deploys the weights after the net and the set of weight exit the cartridge so that the weights overtake the net in flight.

U.S. Pat. No. 6,381,894 to Murphy discloses a bola deployment device for launching a bola from a firearm has a housing member, a plurality of tubular segments with pockets for inserting a bola weight and a stowage area for placing the bola cord. The bola deployment device is attached to the end of a firearm and when fired, the weighted ends of the bola effectively separate from each other as the bola departs from the bola deployment device.

U.S. Pat. No. 6,382,071 to Bertani discloses an apparatus for capturing fleeing animals or persons comprises a gun having a barrel and stock to which are attached a pair of elongated tubular members, one on each side of the gun barrel and substantially parallel thereto. Attached to the end of the gun barrel is a guide assembly which includes a central tube coaxially aligned with the gun barrel and on either side of which are outwardly extending guides. Retainer assemblies provided near the rear ends of the tubular members include chambers which are in fluid communication with the interior of the gun barrel. The apparatus comprises a bola assembly having a central plug from each side of which extends a cord at the end of which are weights. The plug is insertable into the central tube of the guide assembly and the weights are insertable through the elongated tubes for releasable engagement with the retainer assemblies. Firing of a specially designed shell directs gases to the retainer chamber activating the retainer assemblies for release of the weights as the central bola plug is struck by a portion of the shell propelling the bola assembly toward the fleeing animal or person.

U.S. Pat. No. 7,950,176 to Nemtyshkin, et al. discloses a handheld multiple-charge weapon for remote impact on a target with an electric current includes a housing including a launch power supply, a power source, a voltage converter, and a high voltage generator and triggered by a firing element. A clip on the housing carries a plurality of unitary cartridges. Each of said cartridges carries an electrode for contact action on the target and delivering the electric current thereto. The cartridge includes a wire connected to an electrode launched from each of at least two of said cartridges by the power source toward the target when the firing element is actuated in a firing position. The clip moves two cartridges to the firing position and after the firing element is actuated extracts the cartridges and associated wires. The wires are connected to the high voltage generator subsequent to the firing element being actuated after which the cycle of firing and extraction of spent cartridges can be repeated multiple times in manual, semiautomatic or automatic mode.

U.S. Pat. No. 8,245,617 to Martinez, et al. discloses animmobilization device and method of restraining vehicles, persons and animals uses tendrils attached to various devices to engage the target. The immobilization device, system and method includes a housing containing launchable tendrils that are launched from the housing by a propellant. The tendrils may be attached to straps or other elements carried by the immobilization device. The tendrils will engage the target and restrain it if it is a vehicle such as a car, truck, boat, submarine, or like vehicle. In stopping a person or animal the tendrils will deliver a marking package, a shocking package or a snare package to mark, shock or snare the target. Straps may be pulled off the housing leaving the housing near the point of deployment.

U.S. Pat. No. 8,757,039 to Martinez, et al. discloses animmobilization device and method of restraining vehicles, persons and animals uses tendrils attached to various devices to engage the target. The immobilization device, system and method includes a housing containing launchable tendrils that are launched from the housing by a propellant. The tendrils may be attached to straps or other elements carried by the immobilization device. The tendrils will engage the target and restrain it if it is a vehicle such as a car, truck, boat, submarine, or like vehicle. In stopping a person or animal the tendrils will deliver a marking package, a shocking package or a snare package to mark, shock or snare the target. Straps may be pulled off the housing leaving the housing near the point of deployment.

U.S. Pat. No. 8,857,305 to Tseng discloses a rope projection device for capturing an object is provided with a head assembly including an open central chamber and two open inclined cylinders spaced from both sides of the central chamber respectively; a capturing rope including a rope member in the central chamber, and two end weights in the inclined cylinders respectively; and a projection assembly including a housing including a recess having a first through hole, and a cap on the recess and having a second through hole; a sleeve in the housing; a diaphragm on a front end of the sleeve; an air canister in the sleeve; and a mechanism including a spring biased cylindrical member in the sleeve, a receptacle on the cylindrical member, a spring biased sliding member projecting out of the receptacle into a third through hole on the sleeve to be under the first through hole, and a rear sharp member.

U.S. Pat. No. 9,895,579 to Walterscheid discloses a skill toy that is juggled, spun, and flipped in one hand or between both hands. The skill toy has two subassemblies that each contains a rounded translucent shell. The translucent shell surrounds an internal illumination unit, wherein the rounded translucent shell has a maximum diameter of under two inches. The illumination units are motion activated and contain lights. A tether joins the subassemblies together. The tether can be selectively attached to, and detached from, the two subassemblies. The tether has a length of between four inches and six inches, so it is just long enough to span the back of a hand.

U.S. Pat. No. 9,989,336 to Purvis discloses a projectile device for the nonlethal immobilization of threats. The invention includes a plurality of grappling-type hooking assemblies attached by a flexible means to a projectile core, a means for the dispersal of the booking assemblies on or just prior to impact on a target, and a means for ballistically deploying the device from a 12 gauge shotgun, a 35 mm flare gun, a 40 mm grenade launcher, or other suitable launching device. In particular, the hooking assemblies disperse and adhere to the target, while the flexible attachment means entangle and either limit the motion of or immobilize the target.

U.S. Pat. No. 10,036,615 to Norris, et al. discloses a projectile deployment system includes an entangling projectile having a pair of pellets and a tether connecting the pellets. A projectile casing includes a pair of sockets, each socket sized to carry one of the pellets, the sockets being oriented at an acute angle relative to a longitudinal axis of the projectile casing such that the pellets travel apart from one another as they are expelled from the projectile casing. A launcher carries the casing and includes a selectively activatable pressure source capable of expelling the entangling projectile from the projectile casing toward a subject.

U.S. Pat. No. 10,107,599 to Norris, et al. discloses a projectile deployment system includes an entangling projectile including a pair of pellets and a tether connecting the pellets. A projectile casing includes a pair of sockets, each socket sized to carry one of the pair of pellets and a selectively activatable pressure source, carried by the projectile casing. The pressure source is capable of expelling the entangling projectile from the projectile casing toward a subject. A launcher carries an activator operable to activate the pressure source to expel the entangling projectile from the projectile casing toward the subject. The projectile casing is removably engageable with the launcher to allow removal of the projectile casing from the launcher after expulsion of the entangling projectile from the projectile casing.

U.S. Pat. No. 10,345,082 to Norris, et al. discloses a projectile deployment system includes an entangling projectile having a pair of pellets and a tether connecting the pellets. A projectile casing carries the entangling projectile and has a pair of sockets, each socket sized to carny one of the pellets. Each of the sockets is substantially parallel with the horizontal plane and at least a portion of each of the sockets is held at differing vertical elevations when the projectile launcher is held in the firing orientation. The sockets are oriented at an acute angle relative to a longitudinal axis of the projectile casing such that the pellets travel apart from one another as they are expelled from the projectile casing. A launcher carries the projectile casing and a selectively activatable pressure source is operably coupled to the projectile casing and is capable of expelling the entangling projectile from the projectile casing toward a subject.

U.S. Pat. No. 10,551,152 to Norris, et al. discloses a projectile deployment system includes an entangling projectile that includes a pair of pellets and a tether connecting the pellets. A projectile casing includes a pair of sockets, each socket sized to carry one of the pair of pellets, each of the sockets including a longitudinal axis, the pair of sockets being positioned relative to one another such that the longitudinal sockets diverge horizontally away from one another while at least a portion of one of the sockets is arranged vertically higher than another of the sockets. A selectively activatable pressure source is capable of expelling the entangling projectile from the projectile casing toward a subject. A launcher carries an activator operable to activate the pressure source to expel the entangling projectile from the projectile casing toward the subject.

U.S. Pat. No. 10,634,461 to Norris, et al. discloses an entangling projectile for use with a projectile deployment system includes a pair of pellets, at least one of the pair of pellets having a head with a head outer diameter and a shank with a shank outer diameter, the shank outer diameter being less than the head outer diameter. A tether connects the pair of pellets. A shroud is fitted about a shank of the at least one of the pair of pellets, the shroud having a tether opening formed therein to receive the tether, the tether being coupled to the pellet and extending along the shank of the pellet and through the tether opening formed in the shroud.

Although the aforementioned prior art have contributed to the development of the art of a device and method for neutralizing a dangerous individual or animal without the use of deadly force.

Therefore, it is an object of the present invention to provide an improved projectile entangling device for neutralizing an individual or animal.

Another object of this invention is to provide an device and method for entangling an object.

Another object of this invention is to provide an improved projectile entangling device that is easily operated.

Another object of this invention is to provide an improved projectile entangling device that may discharge alternative projectiles.

Another object of this invention is to provide an improved projectile entangling device that may be discharged projectiles multiple times.

Another object of this invention is to provide an improved projectile entangling device that is easily reloaded.

Another object of this invention is to provide an improved cartridge.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to a projectile entangling device for entangling an object. The projectile entangling device comprises a bolt slidably engaging within a receiver. A chamber is within the receiver. A barrel is coupled to the receiver and is adjacent to the chamber. A loading port is in the receiver for positioning a cartridge within the chamber. An ejection port is in the receiver for discharging the cartridge from the receiver. A compressed gas container contains a compressed gas. A gas conduit couples the compressed gas container to the bolt. A valve is positioned within the gas conduit. A trigger activates the valve and dispensing the compressed gas from the compressed gas container, through the gas conduit and exits the bolt. A first projectile is positioned within the cartridge. A second projectile is positioned within the cartridge. A tether is coupled to the first projectile and the second projectile within the cartridge. The first projectile, the second projectile and the tether are propelled from the cartridge and expelled from the barrel upon the compressed gas exiting the bolt. The tether elongates for distancing the first projectile from the second projectile for defining an expanding projectile and entangling with the object.

The invention further relates to an improved cartridge for being discharged from a compressed air firearm. A compressed air dispensed from the firearm. The cartridge comprises a case defining a case chamber. The case has a proximal end and a distal end. The proximal end has a primary input conduit and a secondary input conduit. A primary cylinder is positioned adjacent to the primary input conduit and a secondary cylinder is positioned adjacent to the secondary input conduit. The primary cylinder houses a first projectile. The secondary cylinder houses a second projectile. The primary cylinder and the secondary cylinder concentrate the compressed gas against the first projectile and the second projectile respectively.

In a more specific embodiment of the invention, the first projectile and the second projectile include a treble hook.

In another embodiment of the invention, the first projectile and the second projectile include an adhesive bladder.

The invention also incorporates the method for entangling an object comprising the step of inputting a cartridge into a loading port within a receiver. A bolt is slid within a receiver in a forward direction for inputting the cartridge into a chamber within the receiver. A trigger is depressed on the receiver for discharging a compressed gas for propelling a first projectile, a second projectile and a tether from the cartridge. The bolt is slide within the receiver in a rearward direction for removing the cartridge from the chamber within the receiver. The cartridge is outputted through an ejection port within the receiver.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
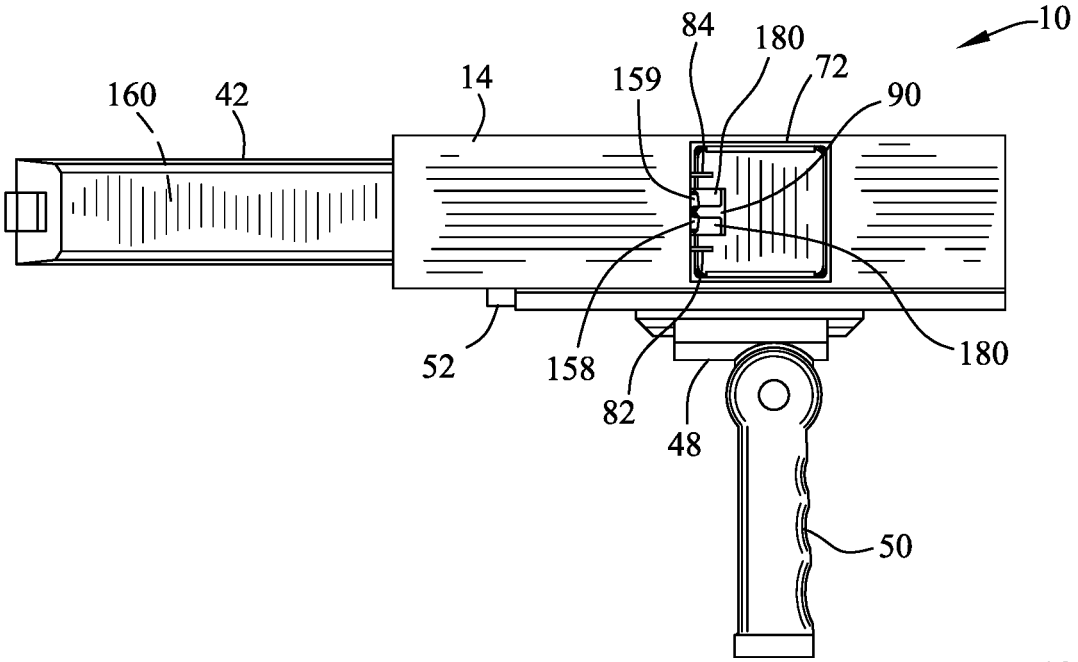
FIG. 1 is a top view of a projectile entangling device incorporating the present invention.
Figure 2:
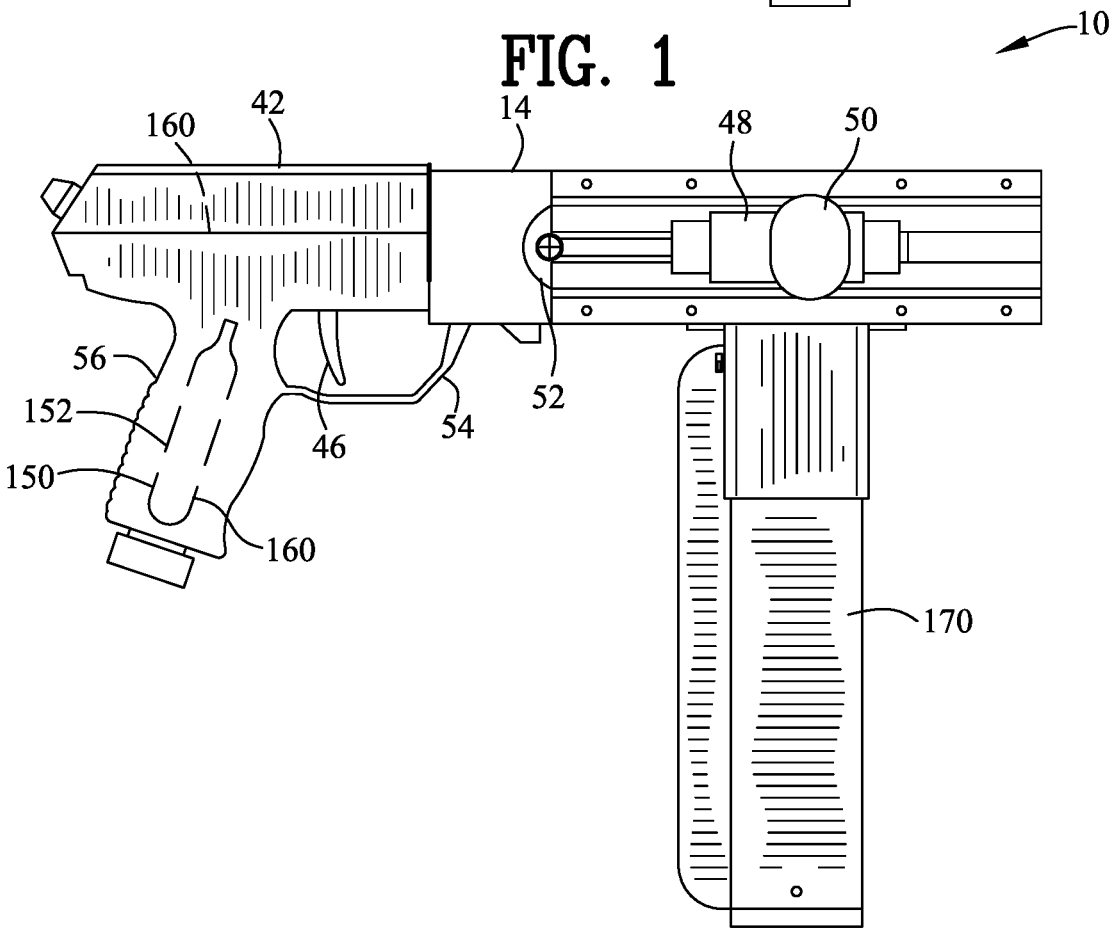
FIG. 2 is a left side view of FIG. 1.
Figure 3:
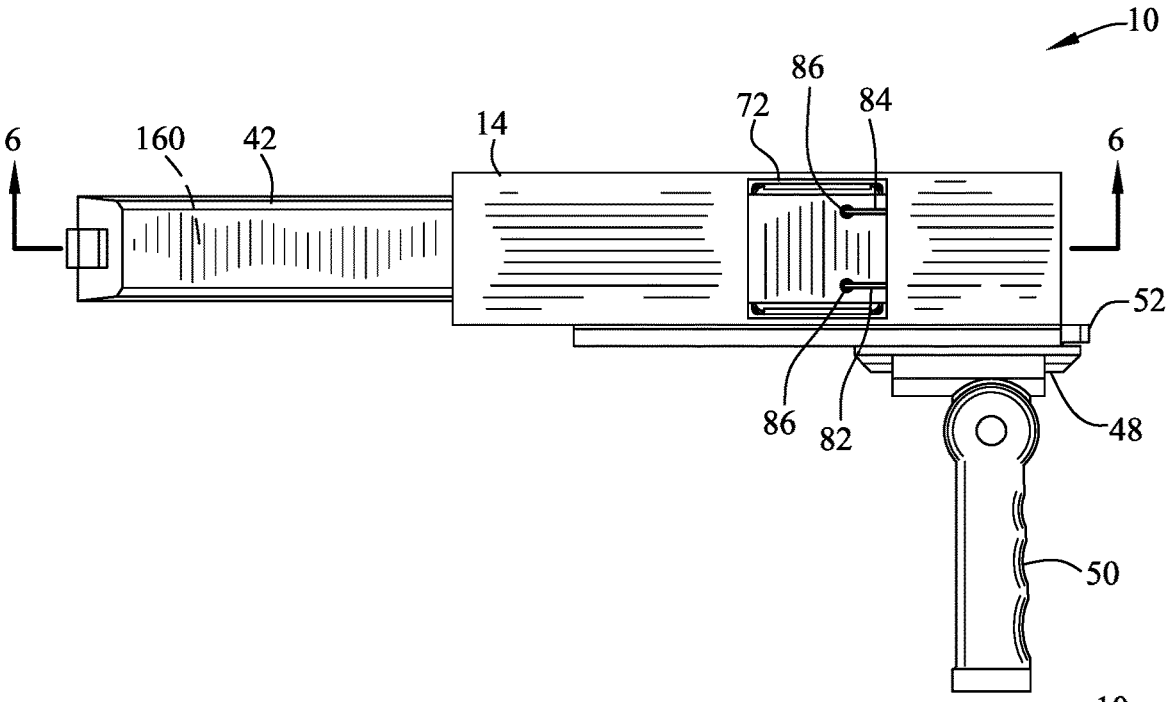
FIG. 3 is a view similar to FIG. 1 illustrating a bolt and sliding forend in a forward position for placing a cartridge into a chamber.
Figure 4:
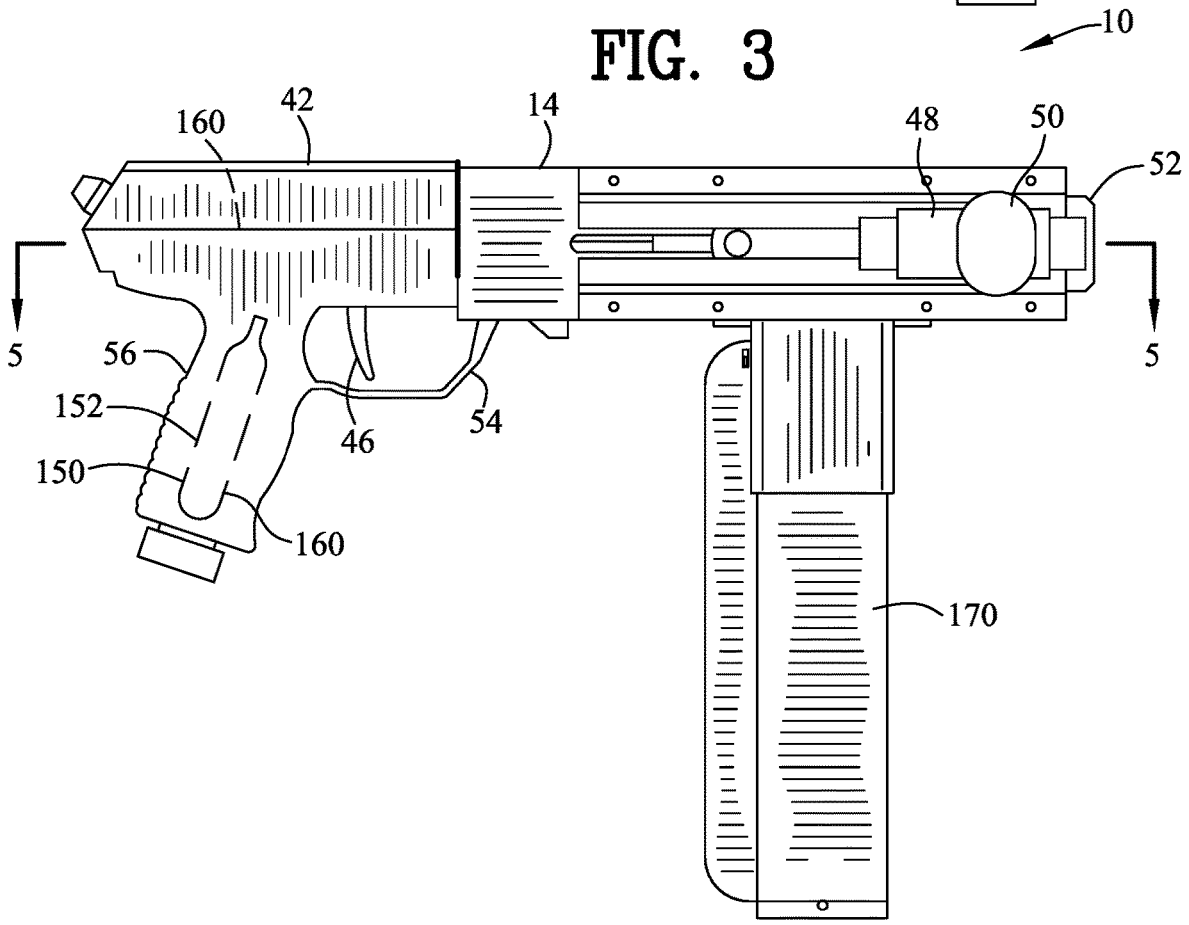
FIG. 4 is a left side view of FIG. 3.
Figure 5:
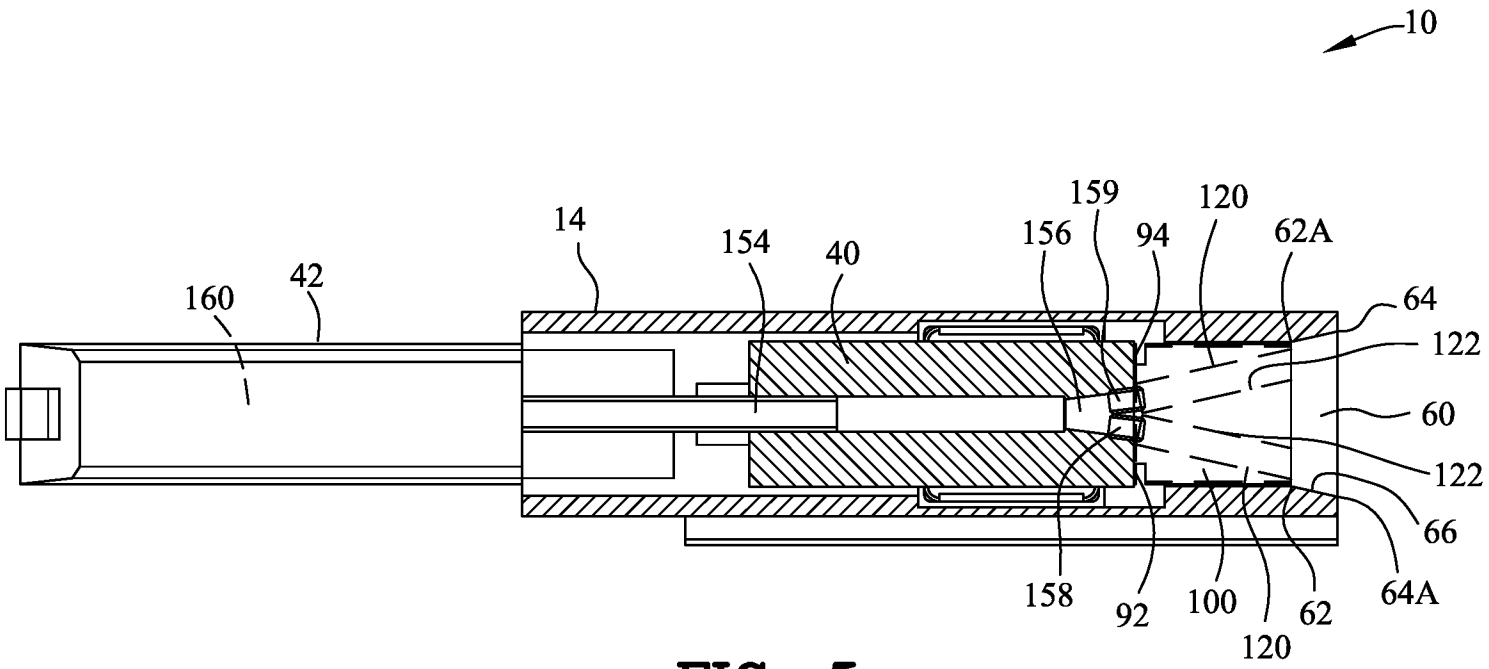
FIG. 5 is a sectional view along line 5-5 in FIG. 4.
Figure 6:
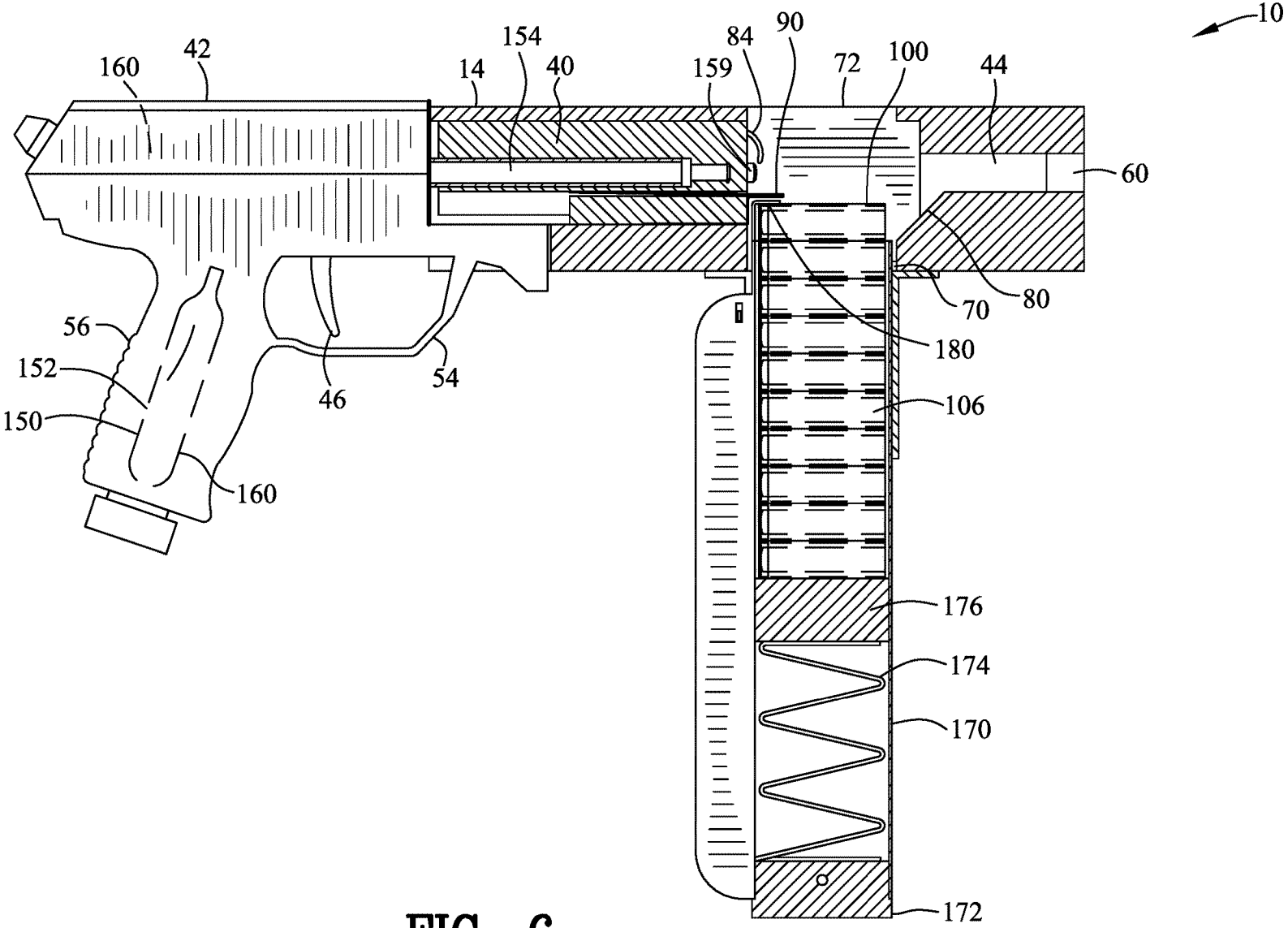
FIG. 6 is a sectional view along line 6-6 in FIG. 3.
Figure 7:
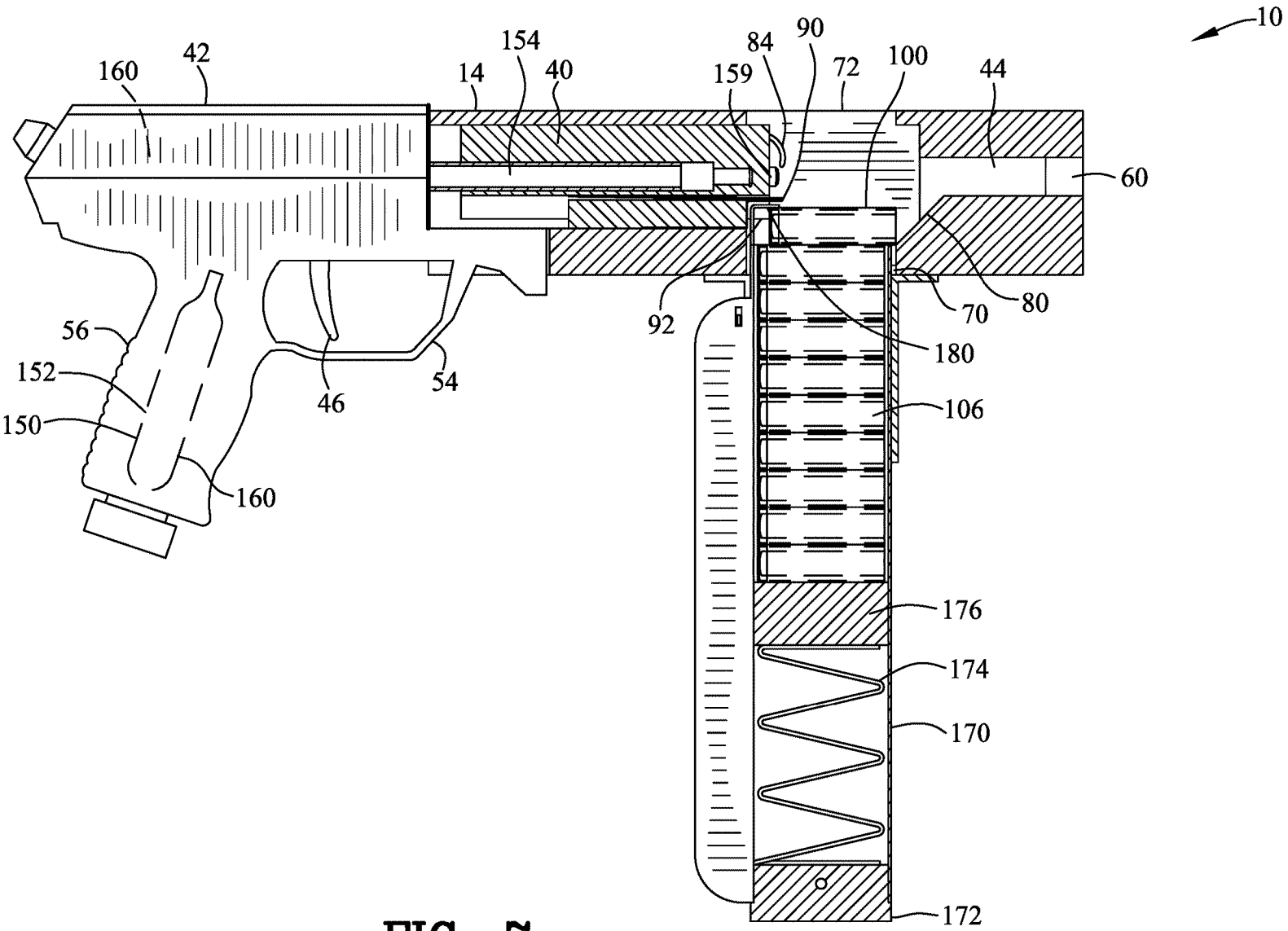
FIG. 7 is a view similar to FIG. 6 illustrating a primary loading member and a secondary loading member engaging the cartridge to displace the cartridge relative to a detachable magazine.
Figure 8:
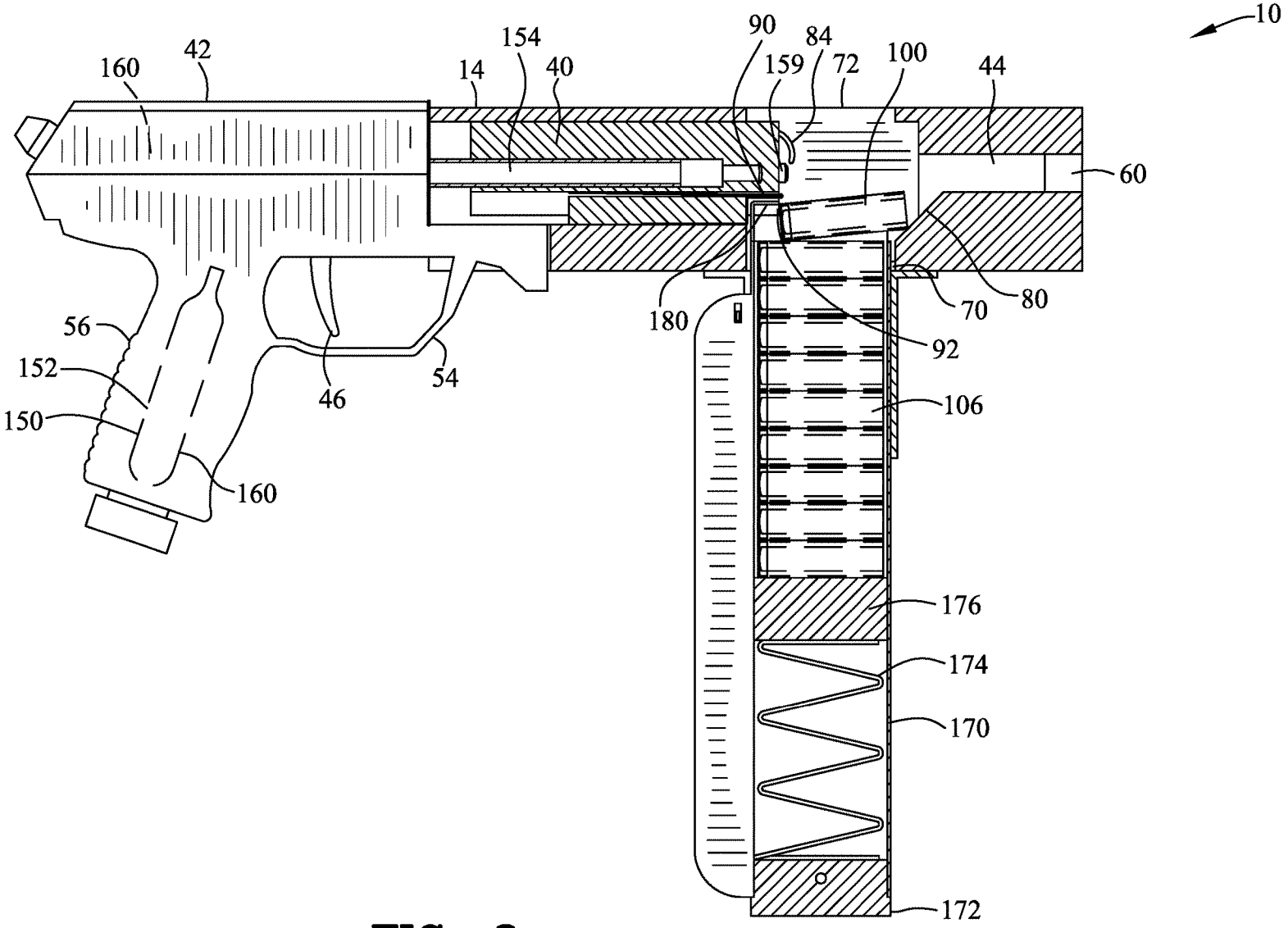
FIG. 8 is a view similar to FIG. 7 illustrating the primary loading member and the secondary loading member further displacing the cartridge relative to a magazine.
Figure 9:
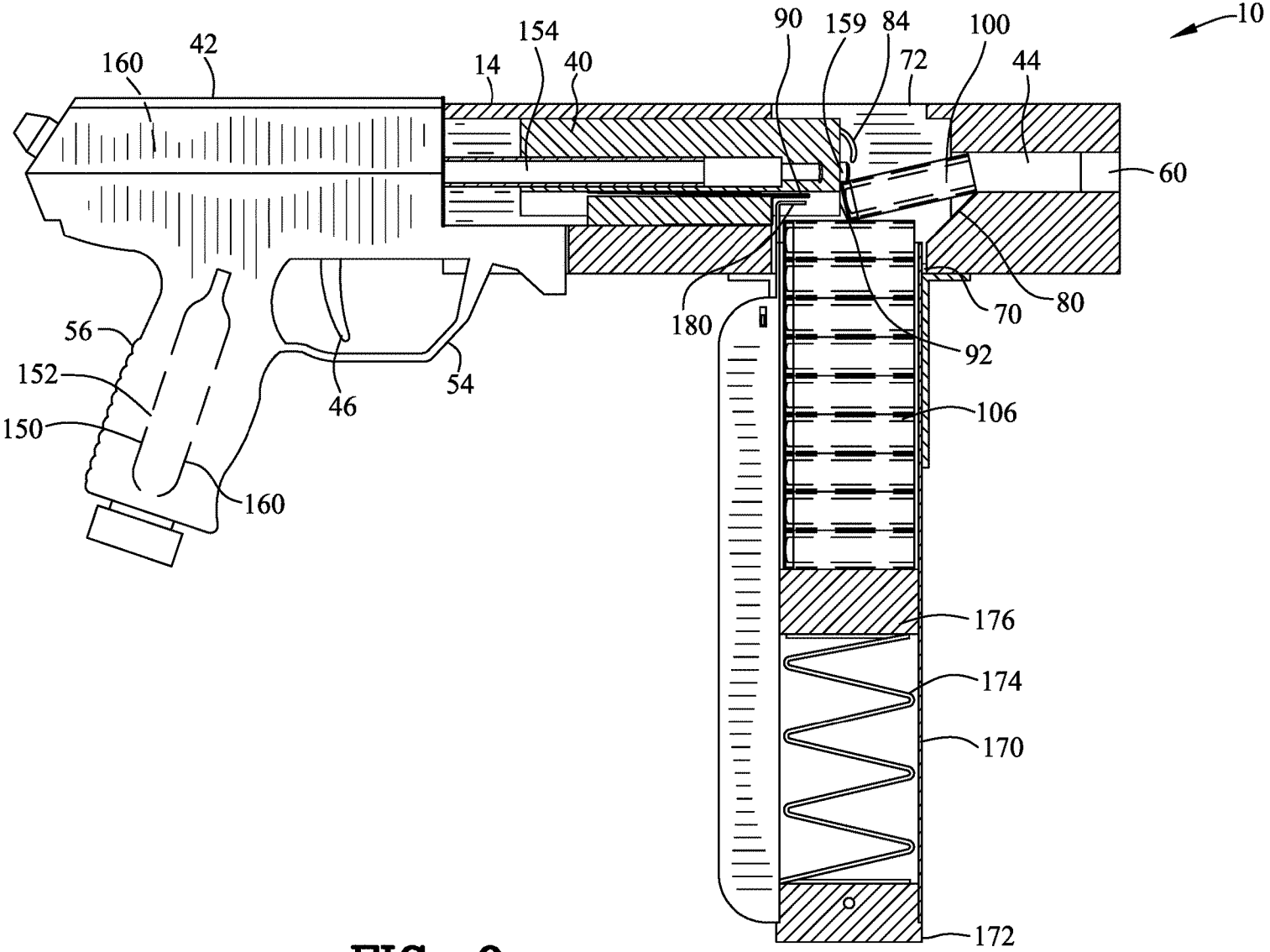
FIG. 9 is a view similar to FIG. 8 illustrating the primary loading member and the secondary loading member further displacing the cartridge relative to a magazine.
Figure 10:
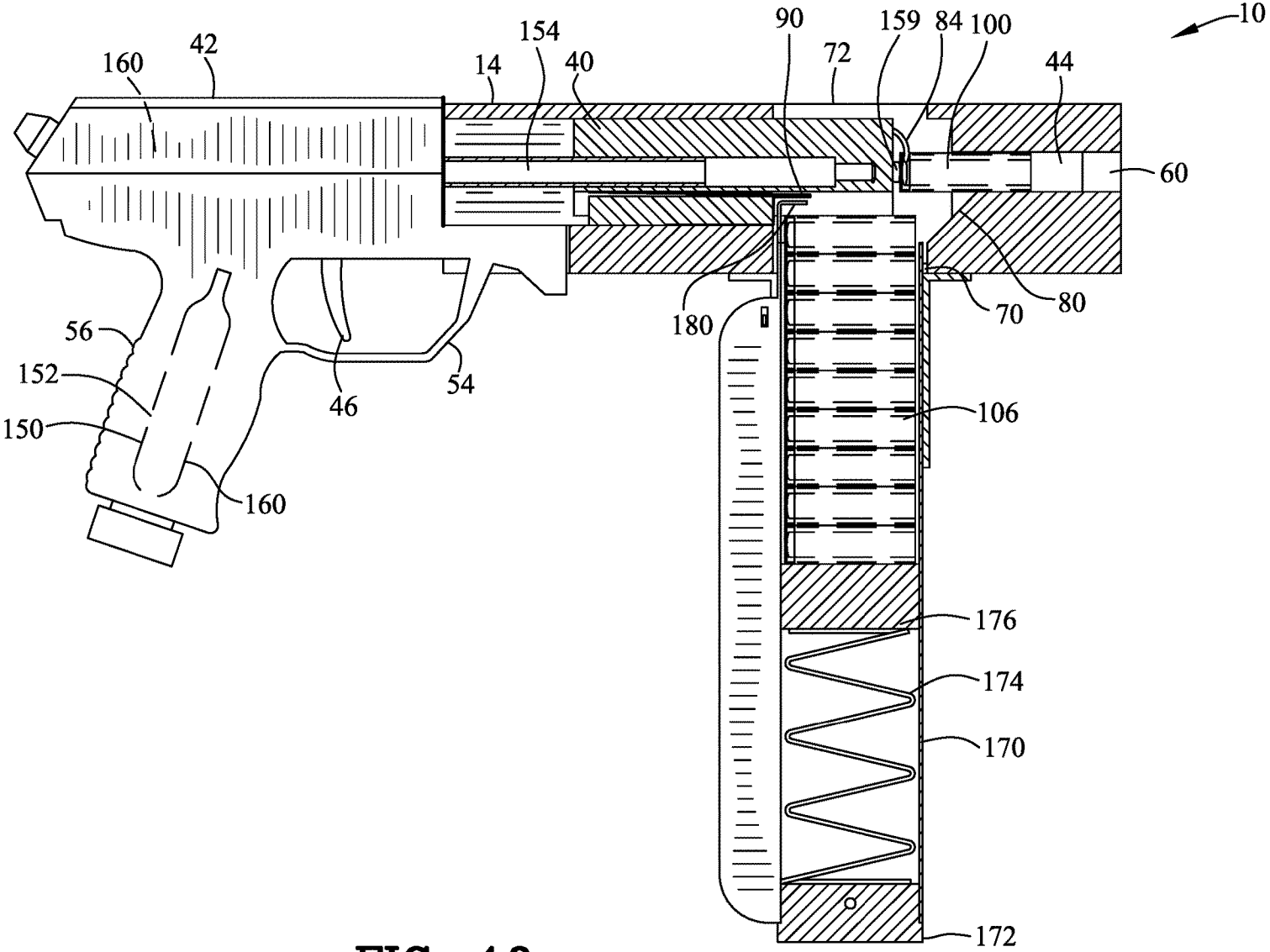
FIG. 10 is a view similar to FIG. 9 illustrating the primary loading member and the secondary loading member further displacing the cartridge and entering a chamber.
Figure 11:
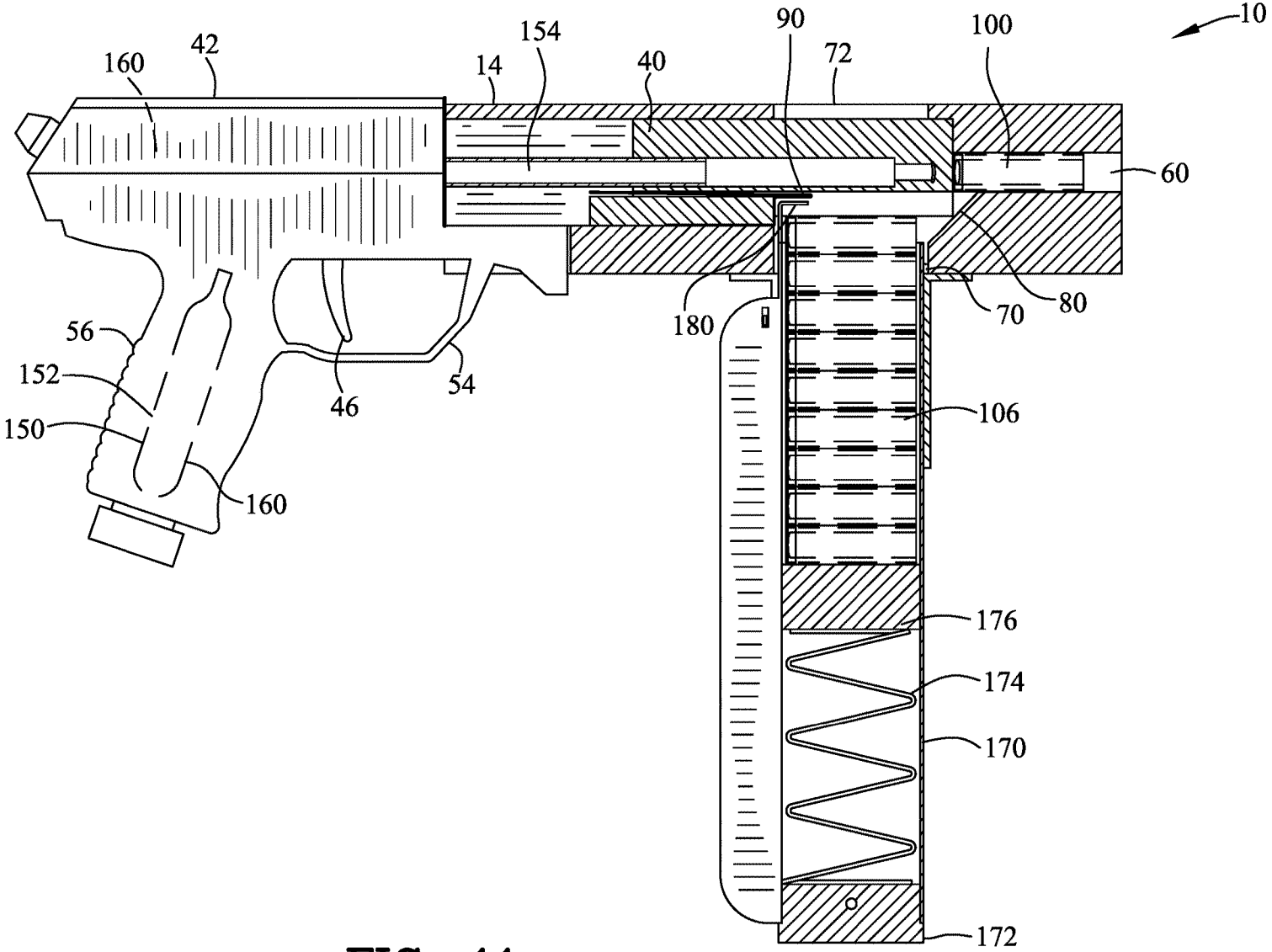
FIG. 11 is a view similar to FIG. 10 illustrating the primary loading member and the secondary loading member positioning the cartridge into the chamber.
Figure 12:
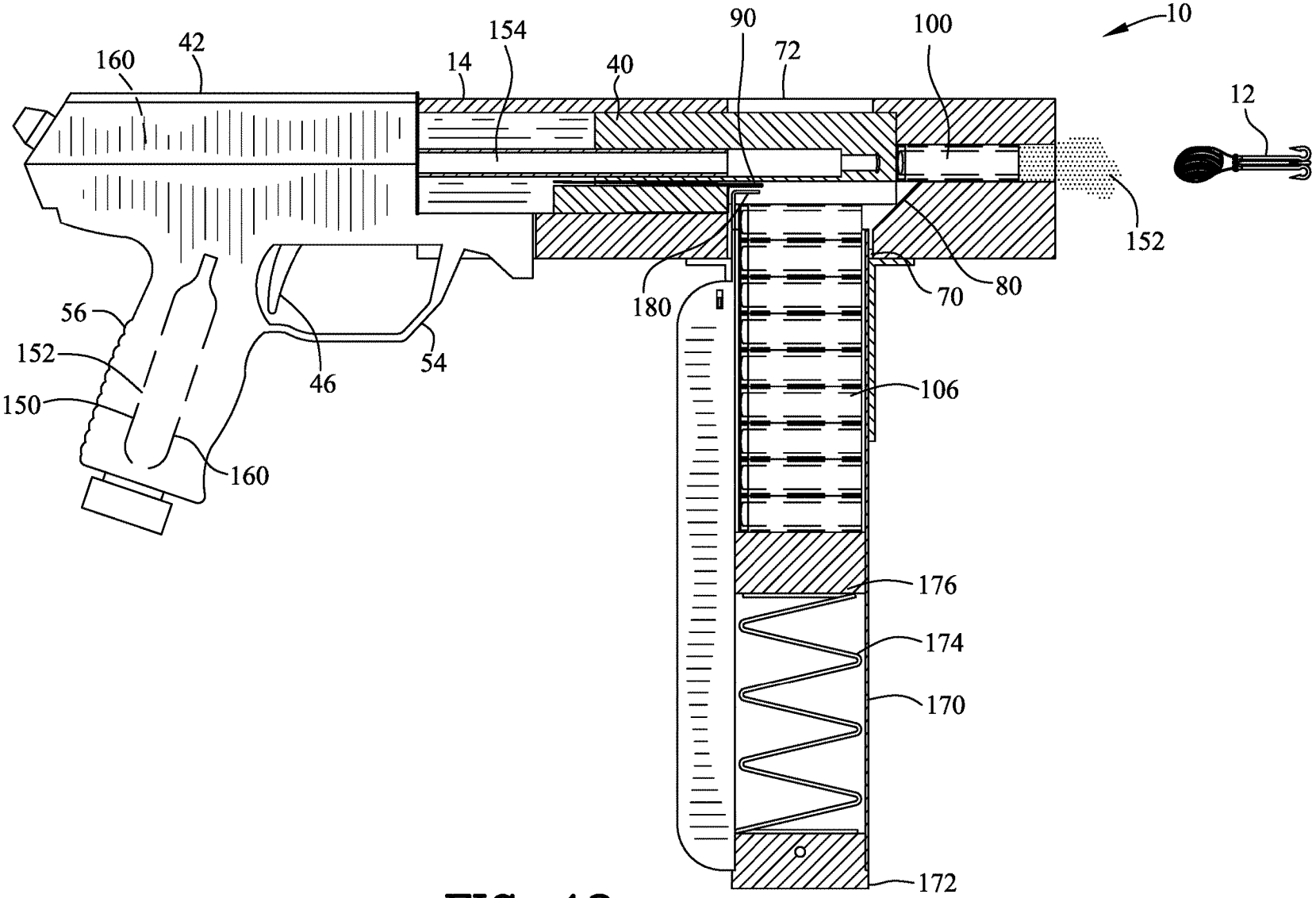
FIG. 12 is a view similar to FIG. 11 illustrating a first projectile, a second projectile and a tether exiting the projectile entangling device.
Figure 13:
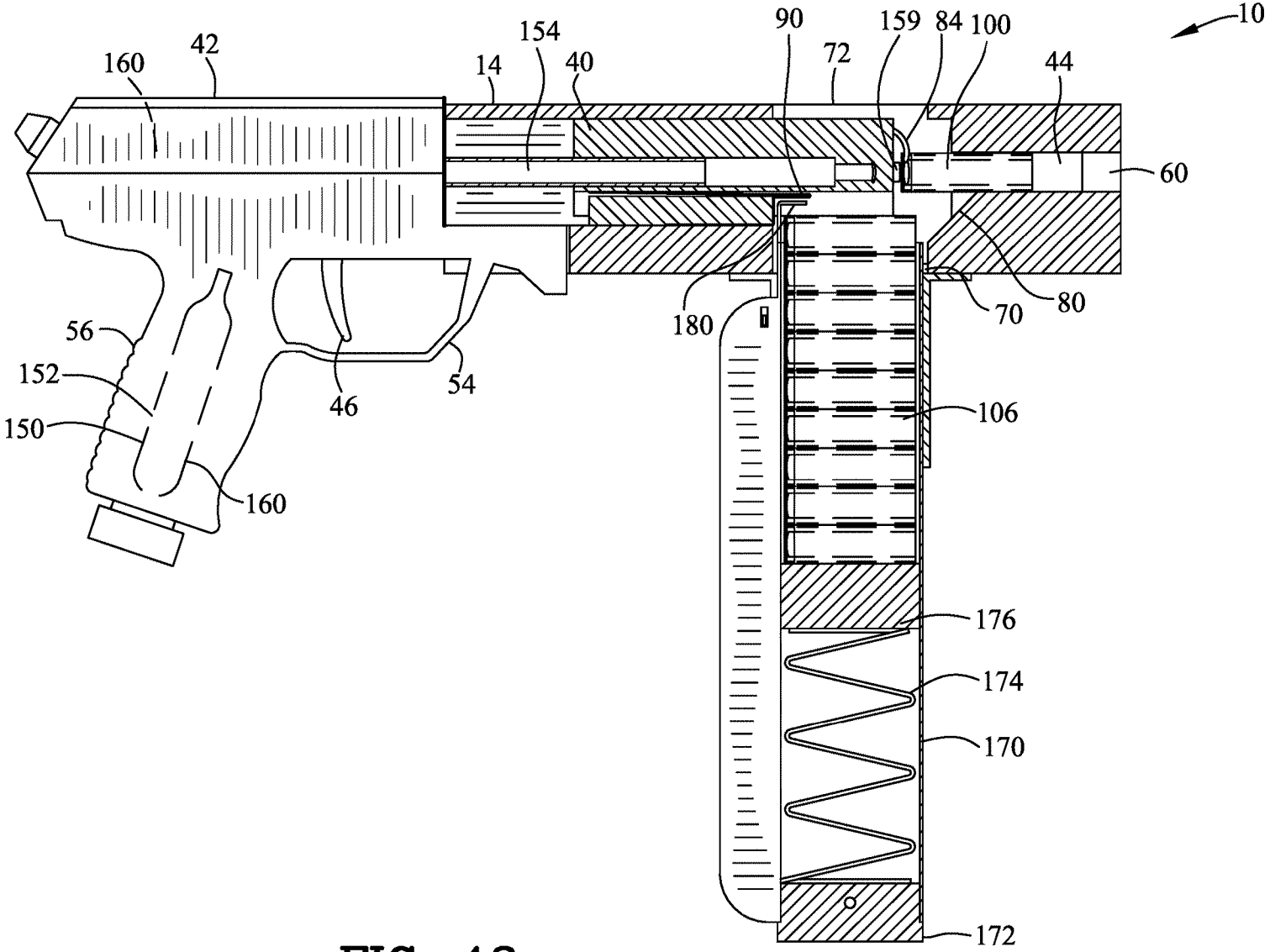
FIG. 13 is a view similar to FIG. 12 illustrating a primary extractor clip and a secondary extractor clip engaging the cartridge and the bolt displaced in a rearward direction for withdrawing the cartridge from the chamber.
Figure 14:
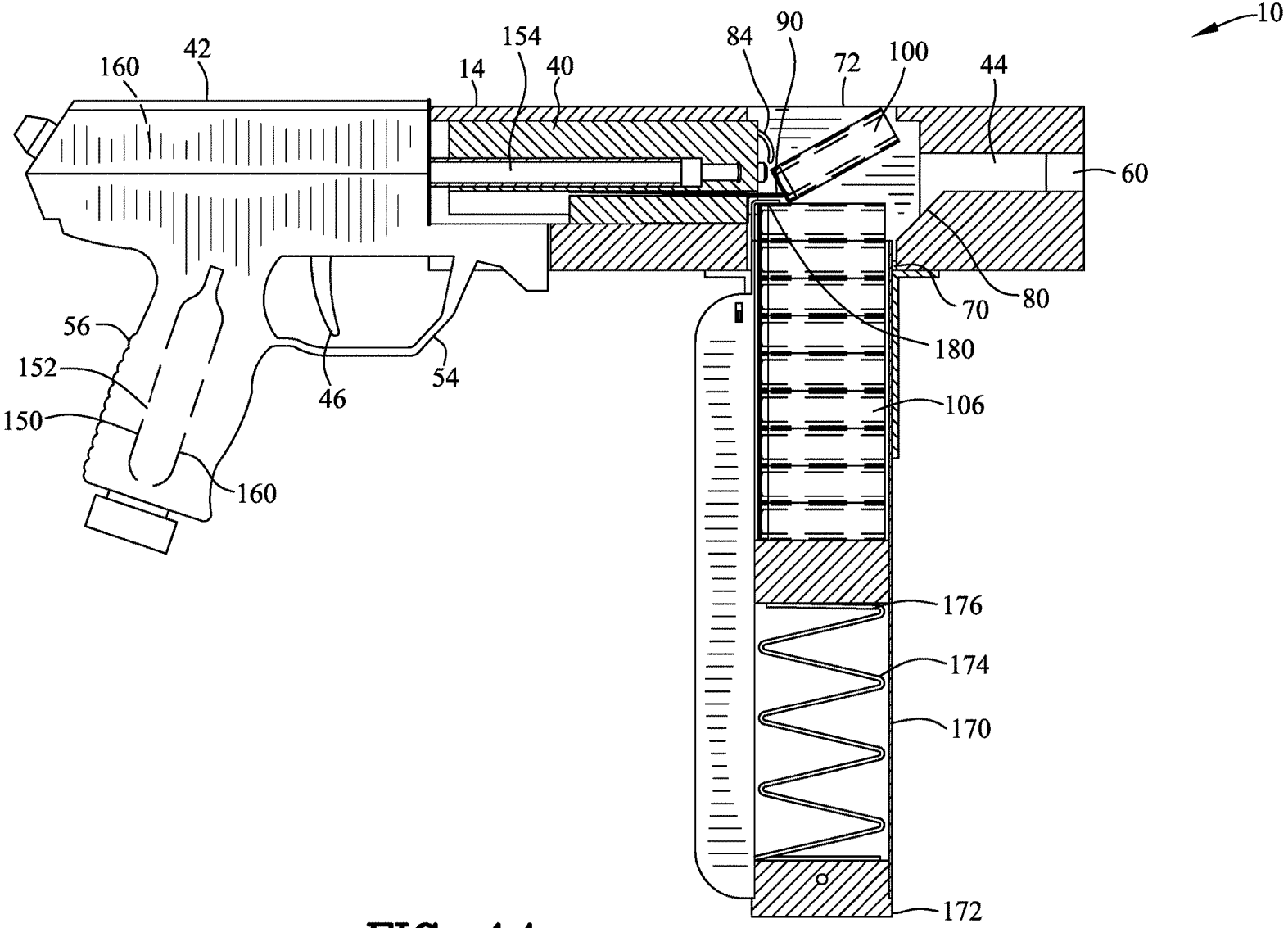
FIG. 14 is a view similar to FIG. 13 illustrating the cartridge engaging an ejection member for disengaging the primary extractor clip and the secondary extractor clip from the cartridge and pivoting the cartridge towards an ejection port.
Figure 15:
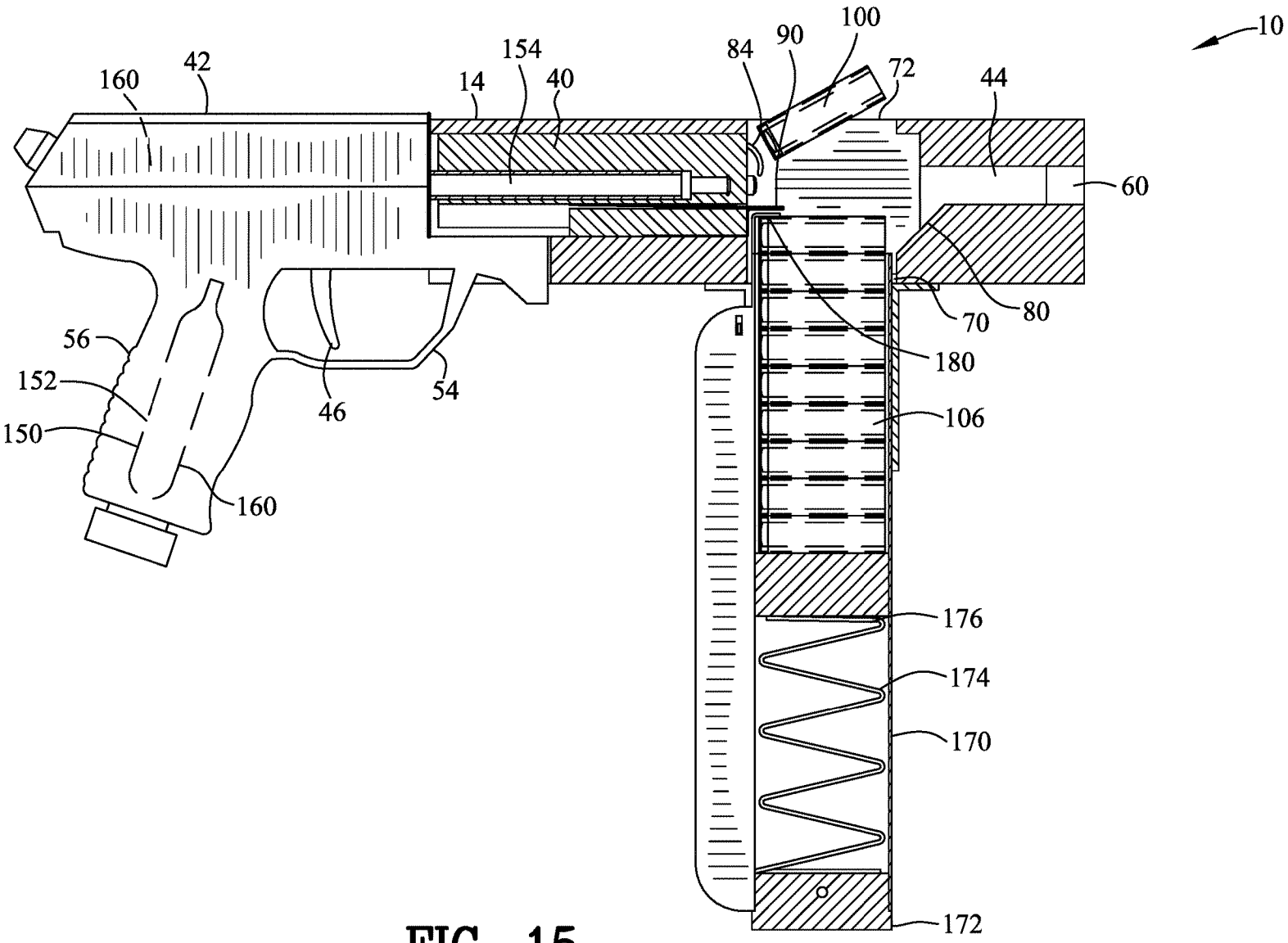
FIG. 15 is a view similar to FIG. 14 illustrating the cartridge traversing the ejection port.
Figure 16:
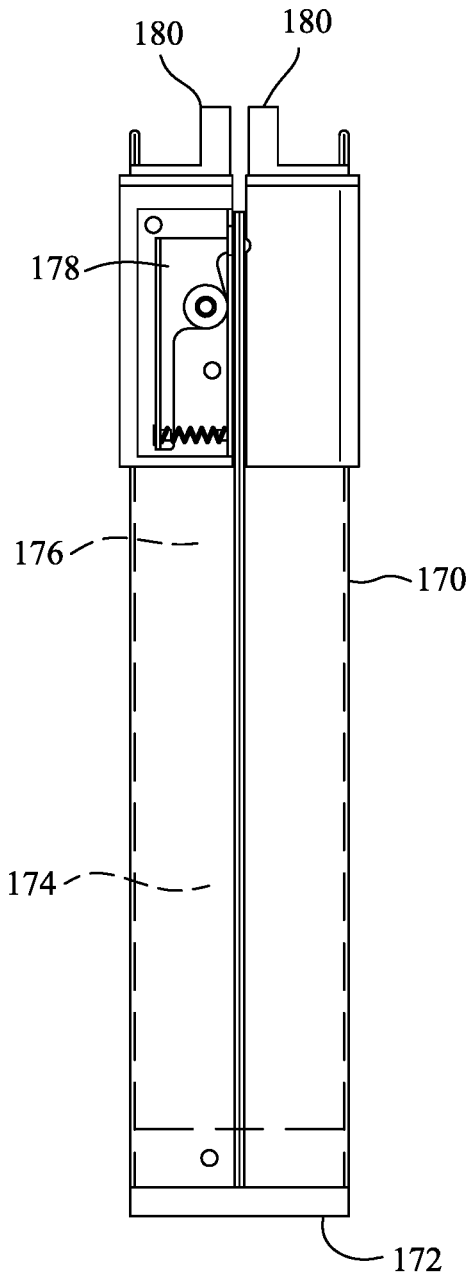
FIG. 16 is a rear view of the detachable magazine of FIG. 2.
Figure 17:
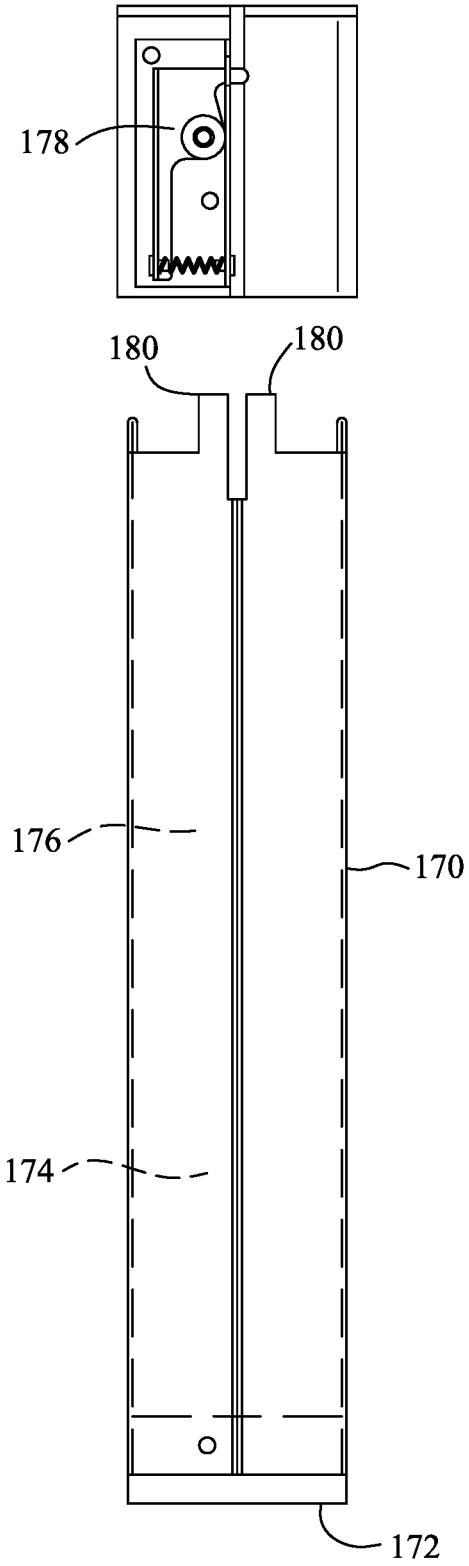
FIG. 17 is an exploded view of FIG. 16.
Figure 18:
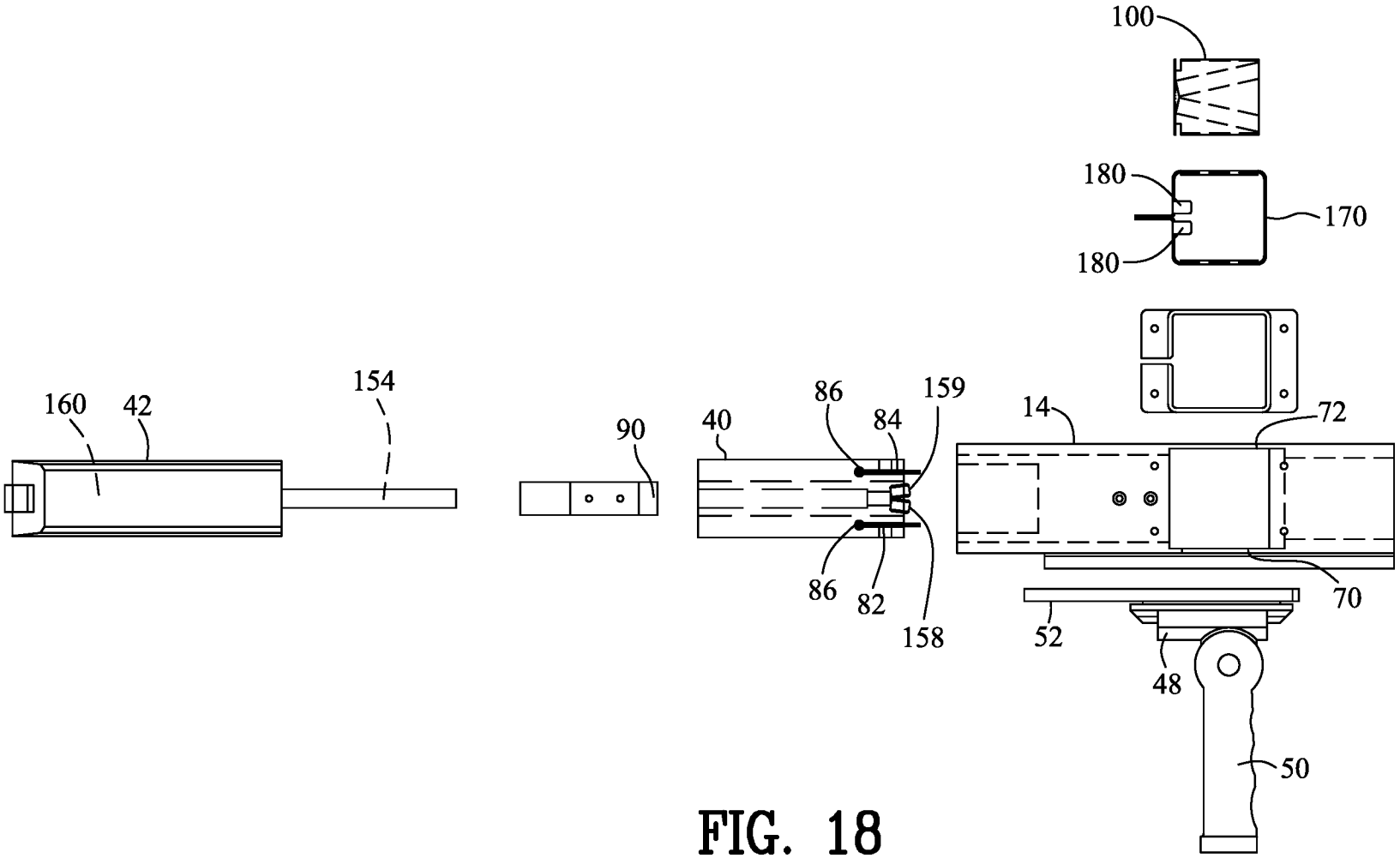
FIG. 18 is an exploded view of FIG. 1.
Figure 19:
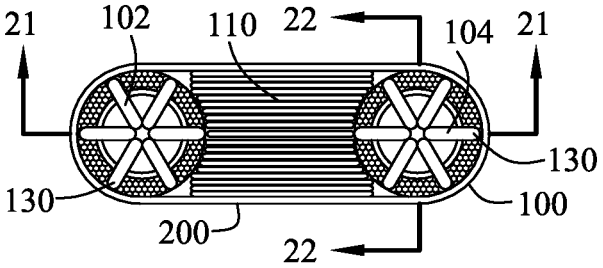
FIG. 19 is a front view of a first cartridge.
Figure 20:
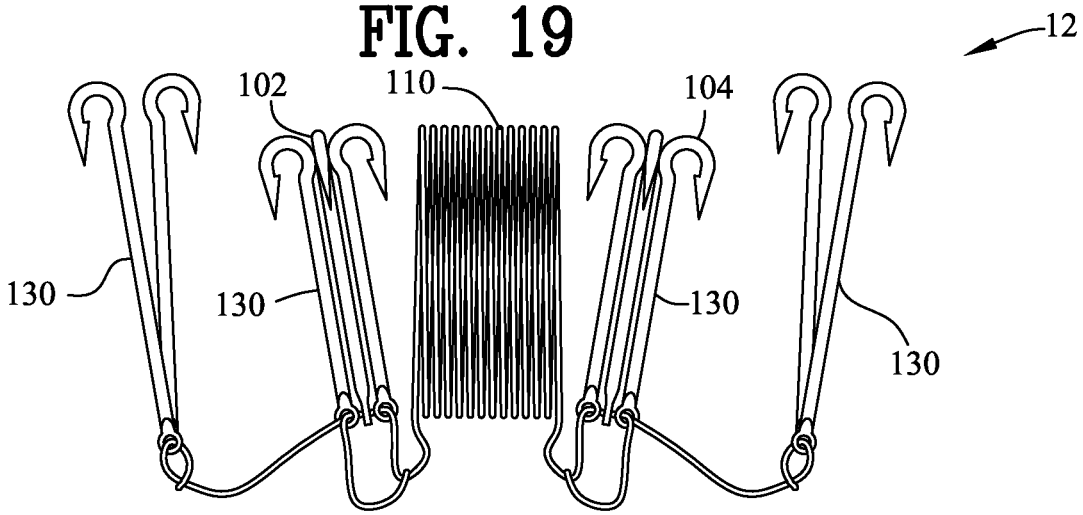
FIG. 20 is a rear view of FIG. 19.
Figure 21:
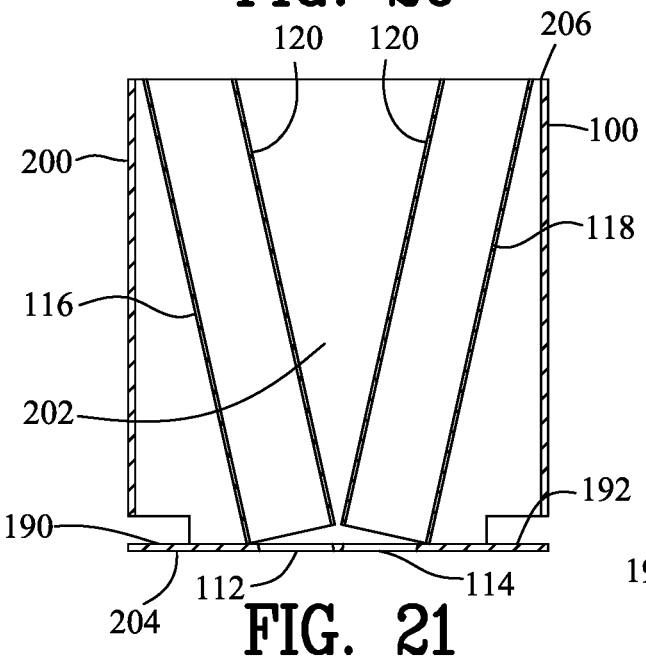
FIG. 21 is a top view of FIG. 19 illustrating an interior primary cylinder and secondary cylinder.
Figure 22:
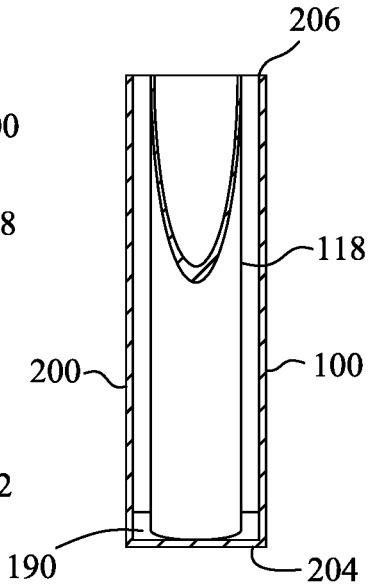
FIG. 22 left side view of FIG. 21.
Figure 23:
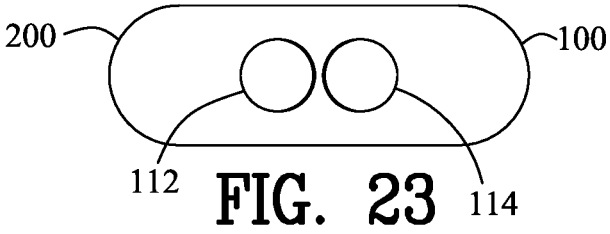
FIG. 23 is a top view of a first treble hook, a second treble hook and a tether incorporated into the first cartridge.
Figure 24:
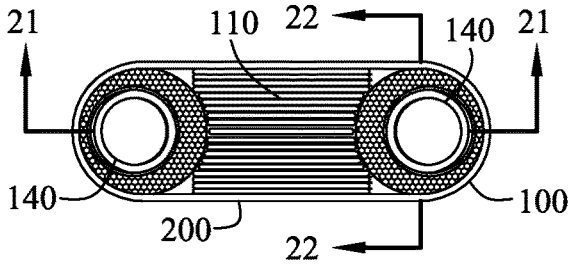
FIG. 24 is a front view of a second cartridge.
Figure 25:
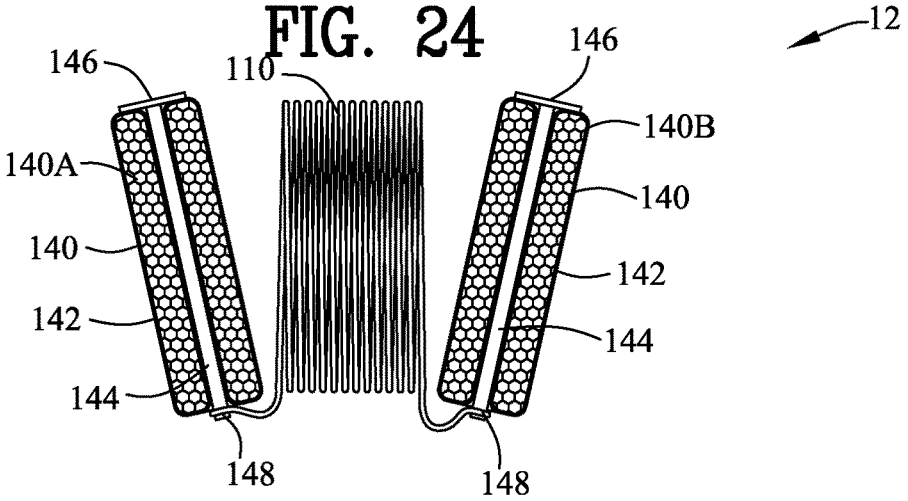
FIG. 25 is a rear view of FIG. 24.
Figure 26:
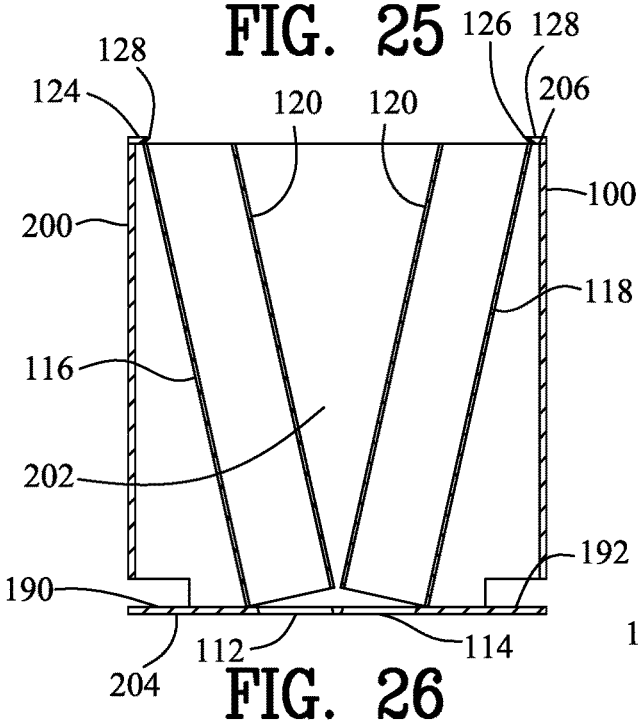
FIG. 26 is a top view of FIG. 24 illustrating an interior primary cylinder and secondary cylinder.
Figure 27:
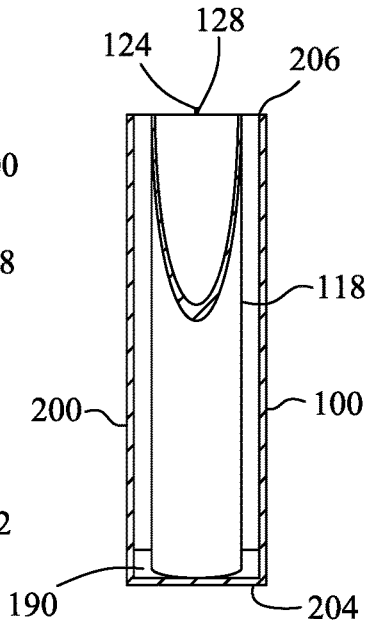
FIG. 27 left side view of FIG. 26.
Figure 28:
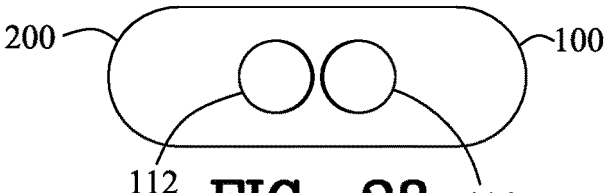
FIG. 28 is a top view of a first adhesive bladder, a second adhesive bladder and a tether incorporated into the second cartridge.

FIGS. 1-18 illustrate a projectile entangling device 10 and method for entangling an object 20. The object may include but not limited to an individual, an animal, bird, insect, reptile or other object. FIGS. 19-28 illustrate a cartridge 100 for deploying a first projectile 102, a second projectile 104 and a tether 110 for entangling the object 20. The projectile entangling device 10 may be a paintball marker device modified for use with the projectile entangling device 10 and cartridge 100. The projectile entangling device 10 comprises a bolt 40 slidably engaging within a receiver 42. A chamber 44 is within the receiver 42. A barrel 60 is coupled to the receiver 42 and is adjacent to the chamber 44. A loading port 70 is in the receiver 42 for positioning the cartridge 100 within the chamber 44. An ejection port 72 is in the receiver 42 for discharging the cartridge 100 from the receiver 42.

A compressed gas container 150 contains a compressed gas 152. The compressed gas container 150 may include one or more CO2 cartridges 162. Furthermore, the compressed gas container 150 may include an external container that is coupled by a flexible hose to the projectile entangling device 10. A gas conduit 154 couples the compressed gas container 150 to the bolt 40. A valve 160 is positioned within the gas conduit 154. A trigger 46 activates the valve 160 and dispenses the compressed gas 152 from the compressed gas container 150, through the gas conduit 154 and exits the bolt 40. The valve 160 may include a Sheridan valve, a Nelson valve, Sterling valve or other air valves.

A first projectile 102 is positioned within the cartridge 100. A second projectile 104 is positioned within the cartridge 100. A tether 110 is coupled to the first projectile 102 and the second projectile 104 within the cartridge 100. The first projectile 102, the second projectile 104 and the tether 110 are propelled from the cartridge 100 and expelled from the barrel 60 upon the compressed gas 152 exiting the bolt 40. The tether 110 elongates for distancing the first projectile 102 from the second projectile 104 for defining an expanding projectile 12 and entangling with the object 20. The tether 110 may be manufactured from a flexible material such as poly-paraphenylene terephthalamide, ultra-high molecular-weight polyethylene, nylon or other flexible cords.

A sliding forend 48 slidably engages the receiver 42. The sliding forend 48 displaces the bolt 40 and positions the cartridge 100 within the chamber 44 and discharges the cartridge 100 from the receiver 42. The sliding forend 48 include a handle 50 for grasped. The sliding forend 48 may be coupled to the bolt 40 by an action bar 52. The receiver 42 may further include the trigger guard 54 for protecting the trigger 46 and preventing inadvertent discharge of the projectile entangling device 10. In order to further improve handling of the projectile entangling device 10 a hand grip 56 may be coupled to the receiver 42.

A magazine 170 is coupled to the receiver 42 adjacent to the loading port 70 in the receiver 42. A plurality of cartridges 106 are contained within the magazine 170. The sliding forend 48 causes the plurality of cartridges 106 to be inputted and outputted from the receiver 42.

The magazine 170 may include a magazine end cap 172, a magazine spring 174 and a magazine follower 176 for guiding the one or more cartridges 106 into the receiver 42. A magazine locking device 178 may lock the magazine 170 to the receiver 42 and prevent inadvertent disengagement between the magazine 170 and the bolt 40. A magazine keeper arm 180 may be utilized for maintaining the cartridges 100 within the magazine 170.

The magazine 170 may include a fixed internal magazine in which cartridges 100 are positioned into the fixed internal magazine from the ejection port 72 and down into the fixed internal magazine. Alternatively, the magazine 170 may include a detachable magazine.

The barrel 60 includes a proximal end 62 and a distal end 64. The proximal end 62 has a proximal end width 62A. The distal end 64 has a distal end width 64A. The distal end width 64A is greater than the proximal end width 62A for defining an increasing tapering width barrel 66. The increasing tapering width barrel 66 permits distancing of the first projectile 102 from the second projectile 104 during displacement in the barrel 60 and after exiting the barrel 60.

The gas conduit 154 may include a Y-shaped discharge 156 defining a primary conduit discharge orifice 158 and a secondary conduit discharge orifice 159. The cartridge 100 may include a primary input conduit 112 and a secondary input conduit 114. The primary input conduit 112 and a secondary input conduit 114 mate with the primary conduit discharge orifice 158 and the secondary conduit discharge orifice 159 respectively for splitting and diverting the compressed gas 152 to the first projectile 102 and the second projectile 104.

The cartridge 100 may include a primary cylinder 116 positioned adjacent to the primary input conduit 112 and a secondary cylinder 118 positioned adjacent to the secondary input conduit 114. The primary cylinder 116 houses the first projectile 102. The secondary cylinder 118 houses the second projectile 104. The primary cylinder 116 and the secondary cylinder 118 concentrate the compressed gas 152 against the first projectile 102 and the second projectile 104 respectively. In order to relay the force from the compressed gas 152 to the first projectile 102 and the second projectile 104, a wadding may be positioned within both the primary input conduit 112 and the secondary input conduit 114 of the cartridge 100 and behind the first projectile 102 and the second projectile 104.

The primary cylinder 116 and the secondary cylinder 118 may define a diverging orientation 120 within the cartridge 100 for distancing of the first projectile 102 from the second projectile 104 after exiting the barrel 60. The diverging orientation 120 in the primary cylinder 116 and the secondary cylinder 118 preferably align with the increasing tapering width barrel 60 for defining a continuous linear barrel rifling 122 between the cartridge 100 and the barrel 60.

The first projectile 102 and the second projectile 104 may include a treble hook 130. Alternatively, the first projectile 102 and the second projectile 104 may include an adhesive bladder 140. More specifically, the adhesive bladder 140 may include a first adhesive bladder 140A and a second adhesive platter 140B. The adhesive bladder 140 may each include an elongated annular bladder 142 in which receives a pin 144. A bladder base plate 146 may engage the pin 144. A tether couple 148 may couple the pin 144 to the tether 110.

The cartridge 100 includes a primary interior rupture device 124 and a secondary interior rupture device 126. The first projectile adhesive bladder 140A is ruptured by the primary interior rupture device 124 upon the first projectile adhesive bladder 140A being displaced from the cartridge 100. The second projectile adhesive bladder 140B is ruptured by the secondary interior rupture device 126 upon the second projectile adhesive bladder 140B being displaced from the cartridge 100. Preferably, the primary internal rupture device 124 and the secondary interior rupture device 126 include a blade 128.

The cartridge 100 may include a primary extractor slot 190 and a secondary extractor slot 192. The bolt 40 may include a primary extractor clip 82 and a secondary extractor clip 84. The primary extractor clip 82 and the secondary extractor clip 84 engage into the primary extractor slot 190 and a secondary extractor slot 192 upon the cartridge 100 entering the chamber 44 and the bolt 40 abutting the cartridge 100. The primary extractor clip 82 and the secondary extractor clip 84 retract the cartridge 100 from the chamber 44. Preferably, the primary extractor clip 82 and the secondary extractor clip 84 are pivotably mounted to the bolt 40 and are biased in a descending orientation by an extractor spring 86. An ejection member 90 may be coupled to the receiver 42. The ejection member 90 ejects the cartridge 100 from the receiver 42 and through the ejection port 72.

A primary loading member 92 and a secondary loading member 94 may be coupled to the bolt 40 for engaging the cartridge 100 and pushing the cartridge 100 into the chamber 44 upon a forward displacement of the bolt 40. The receiver 42 may further include a cartridge loading ramp 80 for assisting in guiding the cartridge 100 from the magazine 170 and into the chamber 44.

The cartridge 100 may be discharged from a compressed air firearm 14. A compressed air 152 is dispensed from the firearm 14. The compressed air firearm 14 may be a paintball marker device modified for use with the cartridge 100. The cartridge 100 comprises a case 200 defining a case chamber 202. The case 200 has a proximal end 204 and a distal end 206. The proximal end 204 has a primary input conduit 112 and a secondary input conduit 114. A primary cylinder 116 is positioned adjacent to the primary input conduit 112 and a secondary cylinder 118 is positioned adjacent to the secondary input conduit 104. The primary cylinder 116 houses a first projectile 102. The secondary cylinder 118 houses a second projectile 104. A tether 110 is coupled to the first projectile 102 and the second projectile 104 within the cartridge 100. The primary cylinder 116 and the secondary cylinder 118 concentrate the compressed gas 152 against the first projectile 102 and the second projectile 104 respectively. The tether 110 may be manufactured from a flexible material such as poly-paraphenylene terephthalamide, ultra-high molecular-weight polyethylene, nylon or other flexible cords.

The primary cylinder 116 and the secondary cylinder 118 may define a diverging orientation 120 within the case 200 for distancing of the first projectile 102 from the second projectile 104 after exiting the compressed air firearm 14.

The first projectile 102 and the second projectile 104 may include a treble hook 130. More specifically, each of the first projectile 102 and the second projectile 104 may include a plurality of treble hooks distanced from each other in order to improve the grasping of the expanding projectile 12 with the object 20. The first projectile 102 and the second projectile 104 may include an adhesive bladder 140.

The case 200 may include a primary interior rupture device 124 and a secondary interior rupture device 126. The first projectile adhesive bladder 140A is ruptured by the primary interior rupture device 124 upon the first projectile adhesive bladder 140A being displaced from the case 200.

The second projectile adhesive bladder 140B is ruptured by the secondary interior rupture device 126 upon the second projectile adhesive bladder 140B being displaced from the case 200. Preferably, the primary internal rupture device 124 and the secondary interior rupture device 126 include a blade 128.

More specifically, the adhesive bladder 140 may include a first adhesive bladder 140A and a second adhesive platter 140B. The adhesive bladder 140 may each include an elongated annular bladder 142 in which receives a pin 144. A bladder base plate 146 may engage the pin 144. A tether couple 148 may couple the pin 144 to the tether 110. The case 200 may include a primary extractor slot 190 and a secondary extractor slot 192 for retracting the case 200 from the compressed air firearm 14.

A method for entangling an object 20 comprises the step of inputting a cartridge 100 into a loading port 70 within a receiver 42. A bolt 40 is slid within a receiver 42 in a forward direction for inputting the cartridge 100 into a chamber 44 within the receiver 42. A trigger 46 is depressed on the receiver 42 for discharging a compressed gas 152 for propelling a first projectile 102, a second projectile 104 and a tether 110 from the cartridge 100. The bolt 40 is slide within the receiver 42 in a rearward direction for removing the cartridge 100 from the chamber 44 within the receiver 42. The cartridge 100 is outputted through an ejection port 72 within the receiver 42.

The method may further include the step of inputting a second cartridge 106 into the loading port 70 within the receiver 42. The bolt 40 is slid within the receiver 42 in a forward direction for inputting the second cartridge 106 into the chamber 44 within the receiver 42. The trigger 46 is depressed on the receiver 42 for discharging a compressed gas 152 for propelling a first projectile 102, a second projectile 104 and a tether 110 from the second cartridge 106. The bolt 40 is slid within the receiver 42 in a rearward direction for removing the second cartridge 106 from the chamber 44 within the receiver 42. The second cartridge 106 is outputted through the ejection port 72 within the receiver 42.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A cartridge for being discharged from a compressed air firearm, a compressed air dispensed from the firearm, the cartridge comprising:

a case defining a case chamber;

said case having a proximal end and a distal end;

said proximal end having a primary input conduit and a secondary input conduit;

a primary cylinder positioned adjacent to said primary input conduit and a secondary cylinder positioned adjacent to said secondary input conduit;

said primary cylinder housing a first projectile;

said secondary cylinder housing a second projectile;

a tether coupled to said first projectile and said second projectile within said case chamber; and said primary cylinder and said secondary cylinder concentrating the compressed gas against said first projectile and said second projectile respectively.

2. The cartridge as set forth in claim 1, wherein said primary cylinder and said secondary cylinder defining a diverging orientation within said case for distancing of said first projectile from said second projectile after exiting the compressed air firearm.

3. The cartridge as set forth in claim 1, wherein said first projectile and said second projectile include a treble hook.

4. The cartridge as set forth in claim 1, said first projectile and said second projectile include an adhesive bladder.

5. The cartridge as set forth in claim 4, wherein said case includes a primary interior rupture device and a secondary interior rupture device;

said first projectile adhesive bladder ruptured by said primary interior rupture device upon said first projectile adhesive bladder being displaced from said case; and said second projectile adhesive bladder ruptured by said secondary interior rupture device upon said second projectile adhesive bladder being displaced from said case.

6. The cartridge as set forth in claim 1, wherein said case includes a primary extractor slot and a secondary extractor slot for retracting said case from the compressed air firearm.

7. A method for entangling an object, comprising the step of:

inputting a cartridge into a loading port within a receiver;

sliding a bolt within a receiver in a forward direction for inputting the cartridge into a chamber within said receiver;

depressing a trigger on the receiver for discharging a compressed gas for propelling a first projectile, a second projectile and a tether from the cartridge;

sliding a bolt within the receiver in a rearward direction for removing the cartridge from the chamber within the receiver; and outputting the cartridge through an ejection port within the receiver.

8. The method for entangling an object as set forth in claim 7, further including the step of inputting a second cartridge into the loading port within the receiver;

sliding the bolt within the receiver in a forward direction for inputting the second cartridge into the chamber within said receiver;

depressing the trigger on the receiver for discharging a compressed gas for propelling a first projectile, a second projectile and a tether from the second cartridge;

sliding a bolt within the receiver in a rearward direction for removing the second cartridge from the chamber within the receiver; and outputting the second cartridge through the ejection port within the receiver.

* * * * *